US005548382A

United States Patent [19]

Koshi et al.

[11] Patent Number: 5,548,382

[45] Date of Patent: *Aug. 20, 1996

[54] DEVELOPING APPARATUS FOR IMPROVING THE DURABILITY OF THE LATENT IMAGE HOLDING MEMBER

[75] Inventors: Makoto Koshi, Kawasaki; Yukio Nishio, Tama; Kazunori Hirose, Hiratsuka, all of Japan

[73] Assignee: Fujitsu Limited, Kawasaki, Japan

[ * ] Notice: The term of this patent shall not extend beyond the expiration date of Pat. No. 5,057,871.

[21] Appl. No.: 355,983

[22] Filed: Dec. 14, 1994

Related U.S. Application Data

[63] Continuation of Ser. No. 66,272, Mar. 12, 1993, abandoned, which is a continuation of Ser. No. 557,057, Jul. 25, 1990, abandoned.

[30] Foreign Application Priority Data

Aug. 1, 1989 [JP] Japan ..... 1-198004

[51] Int. Cl.[6] ..... G03G 15/08

[52] U.S. Cl. ..... 355/259; 355/253; 355/245

[58] Field of Search ..... 355/259, 253, 355/245; 118/653; 492/59; 428/365, 319.1

[56] References Cited

U.S. PATENT DOCUMENTS

| | | | |
|---|---|---|---|
| 3,654,654 | 4/1972 | Abreu et al. | 355/297 X |
| 3,858,287 | 1/1975 | Christoffersen | 29/132 |
| 3,866,572 | 2/1975 | Gunolach | 118/637 |
| 4,194,830 | 3/1980 | Ohnuma et al. | 355/245 |
| 4,205,622 | 6/1980 | Miyake et al. | 355/256 X |
| 4,436,054 | 3/1984 | Ceelen et al. | 355/307 X |
| 4,478,505 | 10/1984 | Tashiro | 355/245 |
| 4,545,670 | 10/1985 | Itoh et al. | 355/253 |
| 4,707,408 | 11/1987 | Iwasawa et al. | 428/36.5 X |
| 4,786,936 | 11/1988 | Ikegawa et al. | 355/253 |
| 4,956,211 | 9/1990 | Saito | 428/36.5 |
| 4,967,231 | 10/1990 | Hosoya et al. | 355/259 X |
| 4,982,689 | 1/1991 | Honda et al. | 355/259 X |
| 5,057,871 | 10/1991 | Hirose et al. | 355/259 |
| 5,062,385 | 11/1991 | Nishio et al. | 118/653 |
| 5,076,201 | 12/1991 | Nishio et al. | 118/653 |
| 5,164,773 | 11/1992 | Nishio et al. | 355/245 |

FOREIGN PATENT DOCUMENTS

| | | |
|---|---|---|
| 53-138349 | 12/1978 | Japan . |
| 54-137346 | 10/1979 | Japan . |
| 55-77764 | 6/1980 | Japan . |
| 57-120947 | 7/1982 | Japan . |
| 60-6846 | 3/1985 | Japan . |

(List continued on next page.)

OTHER PUBLICATIONS

American Physical Society; Electronic Structure of Pendant--Group Polymers, 1978, vol. 18, No. 10. pp. 5717–5739.

*Primary Examiner*—Nestor R. Ramirez

*Attorney, Agent, or Firm*—Armstrong, Westerman, Hattori, McLeland & Naughton

[57] ABSTRACT

A developing device using a one-component developer composed of toner particles, which includes a vessel for holding the developer, and a developing roller rotatably provided within the vessel so that a portion of the roller is exposed therefrom and faces a surface of an electrostatic latent image carrying body to form a developing area. During rotation of the roller, the toner particles are entrained by a surface of the roller to form a developer layer therearound, and are carried to the developing area for a development of an electrostatic latent image formed on the latent image carrying body. The roller and the latent image carrying body are reversely rotated such that the surfaces thereof move upward at the developing area. A blade member is provided within the vessel and is resiliently engaged with the roller for regulating a thickness of the developer layer, and is disposed below the roller to prevent a leakage of the toner particles from the vessel at an underside of the developing roller. The roller has an open-cell foam structure such that pore openings or porous cells thereof have a diameter which is at most twice the average diameter of the toner particles. The roller preferably has an Asker C-hardness of at most 50°.

42 Claims, 16 Drawing Sheets

FOREIGN PATENT DOCUMENTS

| | | |
|---|---|---|
| 60-12627 | 4/1985 | Japan . |
| 61-43767 | 3/1986 | Japan . |
| 62-976 | 1/1987 | Japan . |
| 62-96981 | 5/1987 | Japan . |
| 62-118372 | 5/1987 | Japan . |
| 63-100482 | 5/1988 | Japan . |
| 63-189876 | 8/1988 | Japan . |
| 63-231469 | 9/1988 | Japan . |

DEVELOPING APPARATUS FOR IMPROVING THE DURABILITY OF THE LATENT IMAGE HOLDING MEMBER

This application is a continuation of application Ser. No. 08/066,272, filed Mar. 12, 1993, now abandoned, which is a continuation of application Ser. No. 07/557,057 filed Jul. 25, 1990, now abandoned.

BACKGROUND OF THE INVENTION

1) Field of the Invention

The present invention relates to a developing device used in an electrophotographic field, wherein an electrostatic latent image is visually developed by using a one-component developer, particularly a non-magnetic type one-component developer. The present invention also relates to an electrophotographic printer having such a developing device.

2) Description of the Related Art

As is well known, an electrophotographic printer carries out the processes of: producing a uniform distribution of electrical charges on a surface of an electrostatic latent image carrying body such as an electrophotographic photoreceptor; forming an electrostatic latent image on the electrically charged surface of the electrophotographic photoreceptor by optically writing an image thereon, using a laser beam scanner, an LED (light emitting diode) array, an LCS (liquid crystal shutter) array or the like; visually developing the electrostatic latent image with a developer, i.e., toner, which is electrically charged to be electrostatically adhered to the electostatic latent image zone; electrostatically transferring the developed visible image to a paper; and fixing the transferred image on the paper. Typically, the electrophotographic photoreceptor is formed as a photosensitive drum having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as it enables a stable development of the latent image. Note, typically the toner particles have an average diameter of about 10 μm, and the magnetic fine carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller, provided in the vessel as a developing roller, in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed thereon.

In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held in the vessel, to supplement the toner component as it is consumed during the development process, whereby the component ratio of the two-component developer held by the vessel is kept within the predetermined range. This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using same does not suffer from the above-mentioned disadvantages of the developing device using the two-component developer, because the one-component developer is composed of only a toner component (colored fine synthetic resin particles). Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles composing the magnetic type one-component developer includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. No. 3,152,012 and U.S. Pat. No. 3,754,963, Japanese Examined Patent Publication (Kokoku) No. 60-12627, and Japanese Unexamined Patent Publications (Kokai) No. 62-976, No. 62-118372, No. 63-100482, and No. 63-189876. These developing devices include a vessel for holding the non-magnetic type one-component developer, and a conductive elastic roller provided within the vessel as a developing roller in such a manner that a portion of the elastic roller is exposed therefrom and can be pressed against the surface of the photosensitive drum. The conductive elastic developing roller may be formed of a conductive silicone rubber material or a conductive polyurethane rubber material or the like. When the conductive rubber roller is rotated within the body of the non-magnetic type one-component developer held by the vessel, the toner particles composing the non-magnetic type one-component developer are frictionally entrained by the surface of the conductive rubber developing roller to form a developer layer therearound, whereby the toner particles can be brought to the surface of the photosensitive drum for the development of the electrostatic latent image formed thereon. In this developing device, the development process is carried out in such a manner that, at the area of contact between the photosensitive drum and the conductive rubber developing roller carrying the developer layer, the charged toner particles are electrostatically attracted and adhered to the latent image due to a bias voltage supplied to the conductive solid rubber developing roller.

The developing device further includes a blade member which is resiliently pressed against the surface of the developing roller, to uniformly regulate a thickness of the developer layer formed therearound so that an even development of the latent image can be carried out. The blade member may be also used to electrically charge the toner particles by a triboelectrification therebetween and/or by a charge-injection effect resulting from supply of voltage to the conductive blade member. Of course, when the charge-injection effect is utilized, the blade member is formed of a conductor such as a conductive rubber material, aluminum, stainless steel, brass or the like. The supply of voltage to the blade member also serves to prevent an electrostatical adhesion of the toner particles to the blade member during the regulation of a thickness of the developer layer formed around the developing roller.

The developing device is also provided with a sealing roller, which may be formed of a conductive porors elastic material and which is disposed in the vicinity of a space between a bottom of the developer-holding vessel and the developing roller, to seal the space and thereby prevent a leakage of the toner particles therefrom. The sealing roller is pressed against and is rotated in the same direction as the developing roller, whereby the seal roller also serves as a toner-removing roller for removing remaining toner particles not used for the development of the latent image from the developing roller. The developing and seal rollers are usually driven by a common drive motor through a suitable gear train.

Recently, the electrophotographic printers have become widely used not only as a printer for large computers but also as a printer for personal computers or word processors, and of course, the printer for personal use must have a small size and light weight. Accordingly, there is a strong demand for a small size and light weight developing device using the non-magnetic: type one-component developer, but it is difficult to provide such a small size and light weight developing device, because of the sealing roller incorporated therein. In particular, a large size and high power motor must be used as the common drive motor for driving the developing roller and the sealing roller, because the sealing roller is pressed against the developing roller and they are rotated in the same direction, so that the surfaces of the rollers rub against each other while moving in opposite directions at the contact area therebetween. Also, the gear train between the motor and the rollers and a bearing structure for the rollers must be stoutly constructed to be able to withstand the transmission of a large torque from the motor to the rollers.

The use of the sealing roller may also cause a vibration of the developing roller because, as mentioned above, the surfaces of the developing roller and the sealing roller rub against each other while moving in opposite directions at the contact area therebetween, and of course, when a vibration of the developing roller occurs, an even development of the latent image cannot be ensured.

To ensure a proper development of the latent image by the rubber developing roller, an elasticity or hardness of the developing roller is an important parameter, because the development quality and the development toner density are greatly affected by a contact or nip width between the photosensitive drum and the solid rubber developing roller pressed thereagainst. Namely, the developing roller must be pressed against the photosensitive drum so that a given nip width by which a proper development is obtained is established therebetween. The conductive silicone or polyurethane solid rubber developing roller has a relatively high hardness. For example, when measured by an Asker C-type hardness meter, the solid rubber developing roller showed an Asker C-hardness of about 58°. Accordingly, the solid rubber developing roller must be pressed against the photosensitive drum with a relatively high pressure to obtain the required nip width therebetween, but the higher the pressure exerted upon the photosensitive drum by the developing roller, the greater the premature wear of the drum. Namely, the developing roller should be constituted so as to be as soft as possible.

Japanese Unexamined Patent Publication No. 63-100482 discloses a developing roller comprising a sponge roller element covered with a solid rubber layer, whereby a penetration of the toner particles into the sponge roller element is prevented. This sponge developing roller is softer than the solid rubber developing roller, and thus the required nip width between the developing roller and the photosensitive drum can be obtained without exerting a high pressure upon the drum. Nevertheless, the production of the sponge developing roller is costly due to the complex construction thereof. Also, since the sponge developing roller per se has a solid surface provided by the solid rubber layer, the entrainment of the toner particles thereby is greatly affected by variations of the temperature and air moisture content, as discussed hereinafter in detail.

SUMMARY OF THE INVENTION

Therefore, an object of the present invention is to provide a developing device as mentioned above, wherein the sealing roller for preventing a leakage of the toner particles from the space between the bottom of the developer-holding vessel and the developing roller can be omitted and the size of the developing device thus reduced.

Another object of the present invention is to provide a developing device, wherein the sealing roller for preventing a leakage of the toner particles from the space between the bottom of the developer-holding vessel and the developing roller can be omitted so that the size of the developing device can be reduced, and wherein the developing roller can be constituted to be as soft as possible so that an operating life of the electrostatic latent carrying body can be prolonged.

According to the present invention, there is provided a developing device using a one-component developer, which device comprises: a vessel for holding a one-component developer composed of toner particles; a developing roller rotatably provided within the vessel in such a manner that a portion of the developing roller is exposed therefrom and faces the surface of an electrostatic latent image carrying body to form a developing area therebetween. The developing roller is rotated in such a manner that the surface thereof move upward at the developing area, and during the rotation of the developing roller, the toner particles are entrained by the surface of the developing roller to form a developer layer therearound, and are carried to the developing area for a development of an electrostatic latent image formed on the electrostatic latent image carrying body. The developing device further comprises a developer layer regulating means provided within the vessel and resiliently engaged with the developing roller for regulating a thickness of the developer layer formed around the developing roller. The developer layer regulating means is disposed below the developing roller to serve as a stopper for preventing a leakage of the toner particles from the vessel at an underside of the developing roller.

The developing roller is preferably formed of a conductive open-cell foam rubber material constituted such that a penetration of the toner particles to the open-cell foam structure thereof is prevented, and such that pore openings appear over a surface of the developing roller so that, during a rotation of the developing roller, the toner particles are captured and held by the pore openings of the developing roller to form the developer layer therearound.

When the developing roller is formed of the conductive open-cell foam rubber material, it may have an Asker C-hardness of at most 50°, preferably 35°, and is resiliently pressed against the surface of the electrostatic latent image carrying body, whereby the operating life of the electrostatic latent image carrying body can be prolonged. Also, when the developer layer regulating means is formed as a metal blade member, variations of the developer layer thickness regulated by the metal blade member can be reduced by giving the Asker C-hardness of at most 50° to the developing roller.

As the conductive open-cell foam rubber material of which the developing roller is formed, a conductive open-cell foam polyurethane rubber material is preferably used. In this case, a resolution of a developed image can be maintained at a high level and over a long period. Also, since the conductive open-cell foam polyurethane rubber material is neutral with regard to frictional electrification, the toner particles can be given a desired charge distribution by utilizing a triboelectrification between the developing roller and the toner particles.

The developing roller may be constituted so that a work function thereof approximates, preferably conforms with, that of the toner particles. In this case, the toner particles are charged by a triboelectrification between the developer layer regulating means and the toner particles, whereby the toner particles can be given a desired charge distribution regardless of variations of temperature and air moisture contents.

When the toner particles are charged by a triboelectrification between the developing roller and developer layer regulating means and the toner particles, the developing roller and developer layer regulating means are preferably constituted in such a manner that a relationship of work functions $W_1$ and $W_2$ thereof and a work function $W_3$ of the toner particles is defined by the following formula:

$$(W_1-W_3)\times(W_2-W_3)>0$$

whereby the toner particles can be given a desired distribution.

When the developer layer regulating means is formed of a conductive material for applying a bias voltage thereto to prevent the toner particles from being electrostatically adhered to the developer layer regulating means, the toner particles may be charged by a charge-injection effect resulting from the application of the bias voltage to the developer layer regulation means. In this case, the developing roller and the developer layer regulating means are constituted in such a manner that work functions thereof approximate, preferably conform with, that of the toner particles, whereby the toner particles can be given a desired charge distribution regardless of variations of temperature and air moisture contents. Also, the charge-injection effect resulting from the application of the bias voltage to the developer layer regulation means and a triboelectrification between the developing roller and/or developer layer regulating means and the toner particles may be utilized for charging the toner particles. When the charge-injection effect resulting from the application of the bias voltage to the developer layer regulation means is utilized for charging the toner particles, a difference between the bias voltage applied to the developer layer regulating means and a developing bias voltage applied to the developing roller should be less than a level at which a high electrical current or an electrical discharge occurs between the developer layer regulating means ad the developing roller.

BRIEF DESCRIPTION OF THE DRAWINGS

The other objects and advantages of the present invention will be better understood from the following description, with reference to the accompanying drawings, in which:

FIG. 2(*b*) is an enlarged view of the surface of the conductive open-cell foam rubber developing roller.

DETAILED DESCRIPTION OF THE PREFERRED EMBODIMENTS

Figure 1:
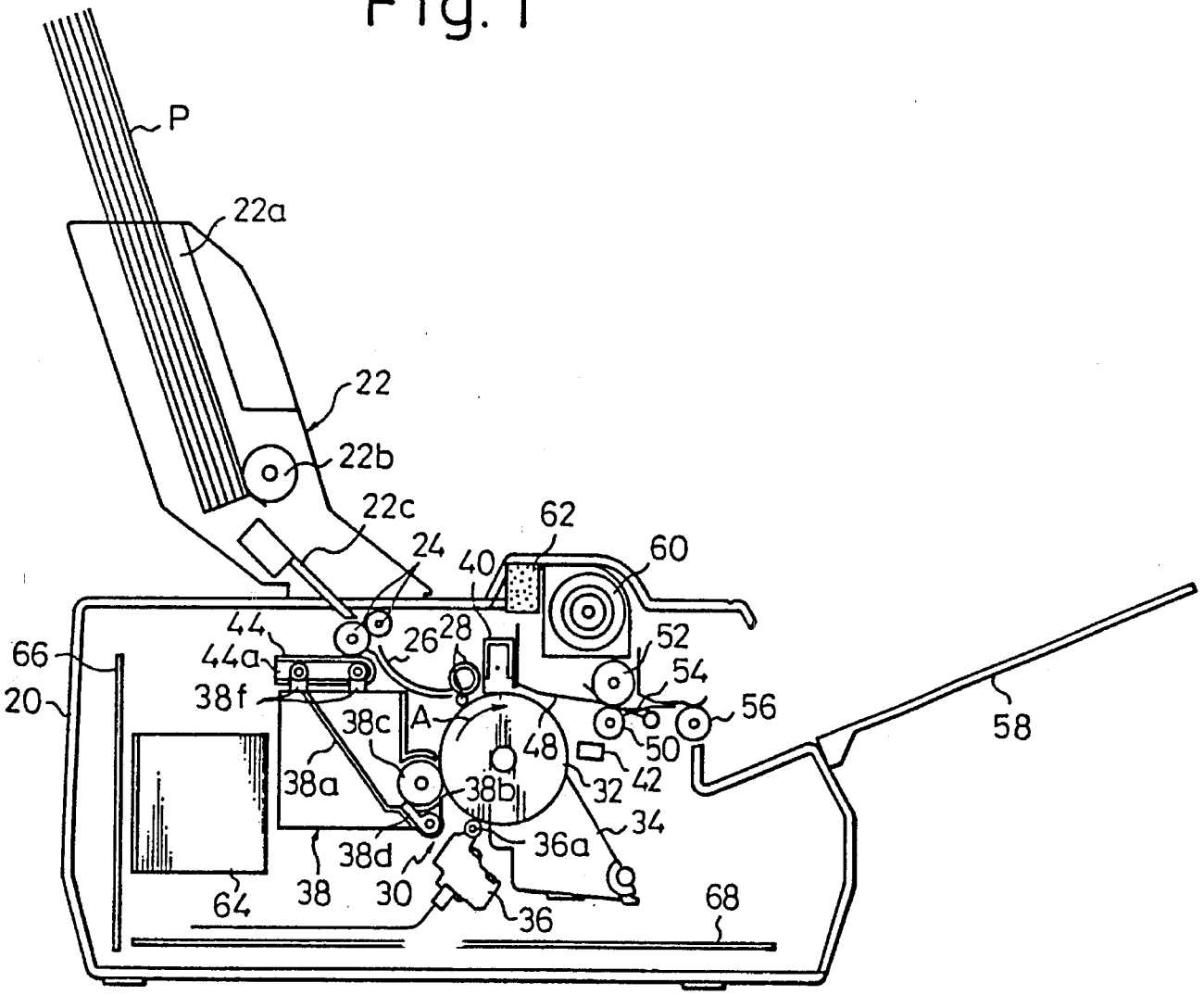
FIG. 1 is a schematic view showing an electrophotographic printer having a developing device according to the present invention.

FIG. 1 schematically shows an electrophotographic printer in which the present invention is embodied, and which is arranged to be used for a personal computer or personal word processor.

The printer comprises a housing 20 having a cut sheet feeder 22 provided on a top wall thereof. The cut sheet feeder 22 includes a hopper 22*a* in which cut sheets or papers P are held, a feed roller 22*b* for drawing out the cut sheets or papers P one by one from the hopper 22*a*, and a guide plate 22*c* for feeding the drawn paper into the housing 20 through a slot formed in the top wall thereof. A pair of delivery rollers 24 is disposed within the housing 20 and adjacent to the guide plate 22*c*, and a guide 26 is extended from the delivery rollers 24 to a pair of delivery rollers 28. While the paper is introduced into the housing 10 along the guide plate 22*c*, the first delivery rollers 24 are driven so that the paper is conveyed along the guide 26 toward the second delivery rollers 28, and when the leading edge of the paper reaches a point just before the second delivery rollers 28, the first delivery rollers 24 are once stopped so that the paper is stationary. When the first delivery rollers 24 are again driven, at a suitable timing, the second delivery rollers 28 are also driven and the paper is fed therebetween.

The housing 10 receives an essential part of the printer, generally designated by a reference numeral 30. This essential part 30 comprises a photosensitive drum 32, a charger/cleaner unit 34, an LED array unit 36, a developing device 38, a transfer charger 40, and a discharge lamp 42. The photosensitive drum 32 comprises a sleeve-like substrate made of a metal such as aluminum, and a photoconductive film formed therearound. The photoconductive film may be composed of an organic photoconductor (OPC). The photosensitive drum 32 may have a diameter of 60 mm and may be rotated in a direction indicated by an arrow A and at a peripheral speed of 70 mm/s. The charger/cleaner unit 34 includes a charger and a cleaner provided within a casing thereof, which may comprise a corona discharger and a fur brush element, respectively. Note, the charger is disposed at the side of the LED array unit 36, and the cleaner at the side of the discharge lamp. The charger or corona discharger of the unit 34 is arranged to give negative charges to the photoconductive film of the drum 32, so that a uniform distribution of negative charges is produced on the photoconductive film surface thereof, a charged area of which may have a potential of about −600 to −650 volts.

On the charged area of the drum 32, an electrostatic latent image is written as a dotted image by the LED array unit 36, on the basis of image data obtained from the personal computer or personal word processor. In particular, the LED array unit 36 has a plurality of light emitting diodes and self-focusing lens elements arranged such that a light emitted from each diode is focussed by the corresponding lens element onto the drum surface. The LED array unit 36 is resiliently biased toward the drum 32 so that a pair of space roller elements 36*a* provided at the sides thereof is abutted against the drum surface, whereby a constant space can be maintained between the rotating drum surface and light emitting end faces of the self-focusing lens elements, to ensure the focussing of the lens elements on the drum surface. When the charged area of the drum 32 is illuminated by the LED array unit 36, the charges are released from the illuminated zone so that it has a potential of about −50 volts. Namely, the electrostatic latent image is formed on the drum surface by a potential difference between the illuminated zone and the remaining zone.

Figure 2A:
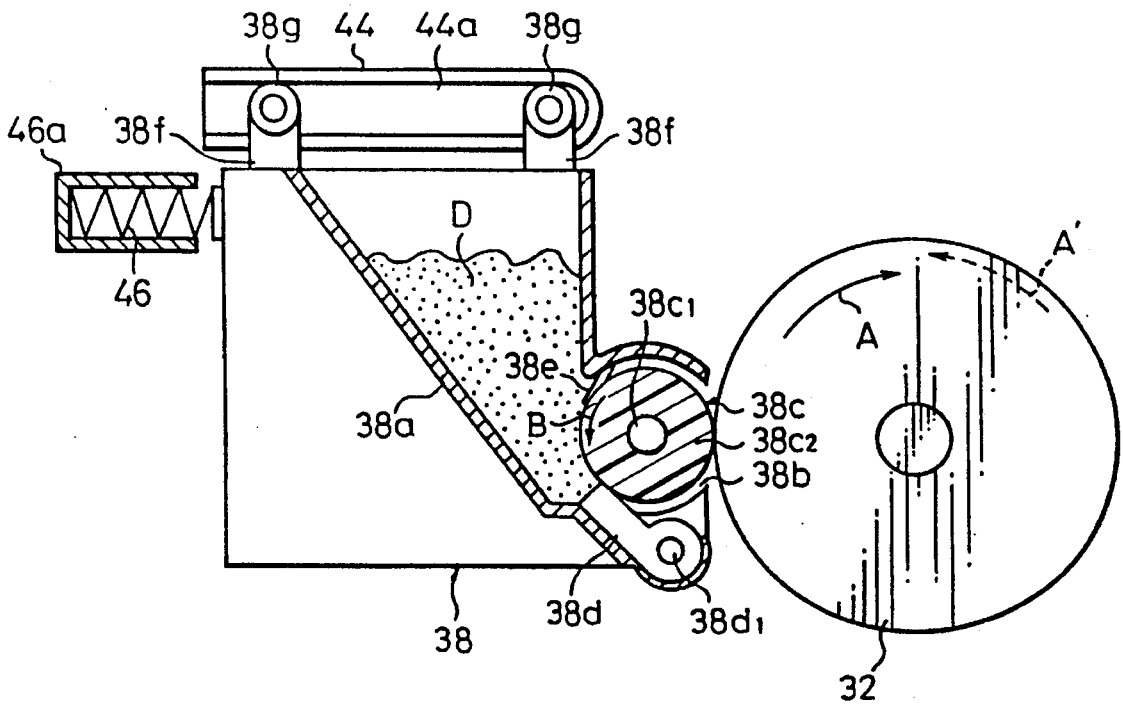
FIG. 2(*a*) is an enlarged schematic view of the developing device used in the electrophotographic printer of FIG. 1.
Figure 2B:
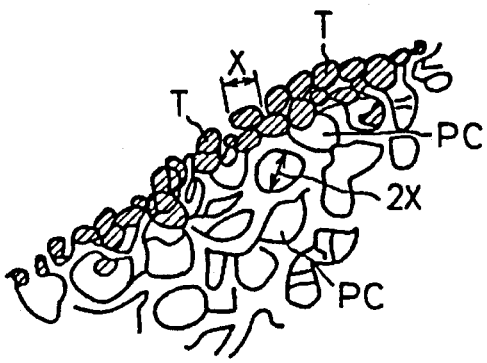

The electrostatic latent image is visually developed by the developing device 38. As best shown in FIG. 2(*a*), the developing device 38 comprises a frame casing in which a vessel or hopper 38*a* is formed to hold a nonmagnetic type one-component developer D composed of colored fine toner particles of a suitable synthetic resin such as polyester or styrene acrylic resin, and having an average diameter of about 10 μm. In this embodiment, the toner particles are negatively charged due to the use of the OPC photosensitive drum 32. Note, the charging of the toner particles will be explained hereinafter in detail. The hopper 38*a* has an opening 38*b* formed therein, and a conductive elastic developing roller 38*c* is provided within the hopper 38*a* in such a manner that a portion of the developing roller 38*c* is exposed from the opening 38*b* and is in contact with the surface of the photosensitive drum 32. The developing roller 38*c* having, for example, a diameter of 20 mm, comprises a shaft 38*c*, supported by the side walls of the frame casing (or hopper 38*a*) of developing device 38, and a single conductive elastic roller element $38c_2$ formed therearound and preferably having a volume resistivity of about $10^4$ to $10^{10}$ Ω·m, most preferably $10^6$ Ω·m. The developing roller 38*c* is connected to a DC power source (not shown) so that a developing bias voltage of from −150 to −400 volts is supplied thereto. The developing roller 38*c* is rotated in a direction indicated by an arrow B, and has a peripheral speed of from 1 to 4 times that of the photosensitive drum 32. During the rotation of the developing roller 38*c*, the toner particles are entrained by the developing roller 38*c* to form a developer layer therearound, and a thickness thereof is uniformalized by a blade member 38*d* resiliently engaged with the developing roller. Thus, the developer layer having the uniformalized thickness is brought to the surface of the photosensitive drum 32, whereby the latent image is visually developed with an even toner density. Namely, in the developing process, the toner particles are electrostatically attracted only to the latent image zone having the potential of about −50 volts, due to the supply of the developing bias voltage to the developing roller 38*c*, as if the latent image zone were charged with the negative toner particles, whereby the development of the latent image is carried out.

As apparent from FIG. 2(*a*), the developing roller 38*c* is rotated in such a manner that the surface thereof moves upward at the developing area at which the developing roller 38*c* is in contact with the photosensitive drum 32. This arrangement is an important feature of the present invention because the blade member 38*d* can be disposed below the developing roller 38*c*, whereby the blade member 38*d* can be utilized as a stopper for preventing a leakage of the toner particles from an underside of the developing roller 38*c*. The leakage of the toner particles is most likely to appear at the underside of the developing roller 38*c*, where a pressure of the developer D held by hopper 38*a* is highest, but the leakage thereat can is effectively prevented due to the existence of the blade member 38*d*. Note, a suitable seal element may be applied to a shaft-like portion of the blade 38*d*. On the other hand, the leakage of the toner particles is relatively little at the top of the developing roller 38*c*, because a pressure of the developer D is smaller at the top of the developing roller 38*c* than at the underside thereof, and because the toner particles existing at the top of the developing roller 38*c* have a tendency to return to the hopper 38*a*, due to the rotation of the developing roller 38*c*. Nevertheless, preferably, the top of the developing roller 38*c* is sealed by a flexible rubber blade 38*e* suspended from a wall of the hopper 38*a* and engaged with the developing roller 38*c*, whereby the leakage of the toner particles at the top thereof can be fully prevented.

The blade member 38*d* is pivotably mounted on a pivot pin $38d_1$ supported by the side walls of the frame casing of the developing device 38, and is resiliently biased against the developing roller 38*c* by, for example, a torsion spring (not shown) incorporated in the pivot pin $38d_1$, so that the blade member 38*d* is resiliently pressed against the developing roller 38*c*, for example, at a linear pressure of about 26 g/mm, to regulate the thickness of the developer layer formed the rearound and thereby ensure an even development of the latent image. Although the blade member 38*d* may be formed of a non-conductive rubber material, preferably a conductive rubber material is used. Also, the blade member 38*d* may be formed of a suitable metal such as aluminum, stainless steel, brass or the like.

When the blade member 38*d* is a conductive material, a bias voltage of from about −200 to −500 volts is applied to the blade member 38*d*, so that the charged toner particles are not electrostatically adhered thereto. This is because, when the blade member 38*d* has an opposite polarity with respect to a potential of the developing bias voltage applied to the developing roller 38*c*, the toner particles will be electrostatically adhered to the blade member 38*d*, to thereby hinder an even formation of the developer layer around the developing roller 38*c*. The application of the bias voltage to the blade member 38*d* also contributes to the charging of the toner particles, due to a charge-injection effect.

As discussed hereinbefore, the developing roller 38*c* must be pressed against the photosensitive drum 32 so that a given nip width by which a proper development is obtained is established therebetween. To this end, as best shown in FIG. 2(*a*), the frame casing of the developing device 38 is suspended from a guide support 42 so as to be movable toward and away from the photosensitive drum 32, and is resiliently biased toward the drum 32 by a coil spring 46 acting on the frame casing of the developing device 38, whereby the developing roller 38*c* is resiliently pressed against the drum 32. In particular, a pair of tongue pieces 38*g* is upwardly projected from the top wall of the frame casing of the developing device 38, each tongue piece 38*g* having a guide roller 38*h* rotatably attached to a free end thereof, and the guide support 42 has a horizontal guide slot 44a in which the guide rollers 38*h* are received. The guide support 42 and a spring holder 46*a* for the coil spring 46 are fixed to a printer frame (not shown) provided in the housing 20. With this arrangement, it is possible to resiliently press the developing roller 38*c* against the photosensitive drum 32 so that the given nip width for the proper development of the latent image can be established therebetween.

When the developed toner image reaches the transfer charger 40, which may comprise a corona discharger, due to the rotation of the photosensitive drum 32, the paper which was stationary is moved by driving the first delivery roller 24 so that the leading edge thereof is fed between the second delivery rollers 28, which are also driven, whereby the paper can be passed through a clearance between the transfer charger 40 and the drum 32. During the passage of the paper through the clearance, the transfer charger 40 gives positive charges to the paper so that the developed toner image having the negative charges is electrostatically transferred to the paper. The paper carrying the transferred toner image is guided by a conductive guide plate 48, which may be made of a suitable metal, and is then introduced into a toner image fixing device comprising a heat roller 50 and a backup roller 52. When the paper carrying the transferred toner image is discharged from the clearance between the transfer charger 40 and the drum 32, it is electrostatically adhered to the conductive guide plate 48 by the electrostatic image force established therebetween due to the conductivity of the guide plate 48 and the charges of the paper. Although the electrostatic image force is sufficient to hold the paper onto the guide plate 48, it is so small that the paper can be traveled along the guide plate 48 by the thrust force obtained from the second delivery rollers 28. With this guide arrangement, it is possible to guide the paper to the toner image fixing device without causing damage to the transferred toner image carried by the paper. While the paper carrying the transferred toner image is passed between the heat roller 50 and the backup roller 52, the toner particles forming the transferred toner image are heat-fused by the heat roller 50 so that the transferred toner image is heat-fixed to the paper. During the fixing process, it is possible for the paper to become entangled with the heat roller 50, but this entanglement can be eliminated by a nail element 54 engaged with the heat roller 50. The paper carrying the fixed toner image is discharged by a discharge roller 56 out of the housing 20 and onto a tray 58 provided at an outside thereof.

The area of the photosensitive drum 32 from which the developed toner image is transferred to the paper is illuminated by the discharge lamp 42, so that residual charges are discharged from the illuminated area. Also, the remaining toner particles not transferred to the paper are removed from the surface of the photosensitive drum 32 by the cleaner element or fur brush element of the charger/cleaner unit 34, and the cleaned area thereof is then charged by the charger of the charger/cleaner unit 34.

In FIG. 1, reference numeral 60 indicates a ventilator for suppressing a rise in temperature within the housing 10, and an ozone filter 62 is attached to a discharge port of the ventilator 60 to eliminate ozone generated by the corona dischargers and in the exhausted air. Also, reference numerals 64, 66 and 68 indicate an electric power source for the above-mentioned various elements of the printer, a control circuit board for controlling the driving of these elements, and an interface circuit board through which the printer is connected to a personal computer or word processor, respectively.

Note, when the photoconductive film of the photosensitive drum 32 is composed, for example, of a selenium or amorphous slicone photoconductor on which a distribution having a positive charge is produced, the toner particles are positively charged and a positive bias voltage is applied to the developing roller 38*c* and the blade member 38*d*.

According to another feature of the present invention, the developing roller 38*c*, and therefore the roller element $\mathbf{38}c_2$, is formed of a conductive open-cell foam rubber material, to be given a softness, but is constituted such that a penetration of the toner particles into the open-cell foam structure thereof is prevented. For example, as shown in FIG. 2(*b*), the open-cell foam rubber roller element $\mathbf{38}c_2$ is constituted such that pore openings or porous cells PC thereof have a diameter which is at most twice the average diameter X of the toner particles T, whereby a penetration of the toner particles to the inside of the open-cell foam structure of the roller element $\mathbf{38}c_2$ can be prevented, and thus a softness thereof can be maintained over a long period. This is because, for example, when the two toner particles having a 10 μm diameter are captured by a porous cell having a 20 μm diameter, these toner particles interfere with each other in such a manner that they are prevented from penetrating the open-cell foam structure of the roller element $\mathbf{38}c_2$. The conductive open-cell foam rubber material may be based upon polyurethane, silicone, acrylonitrile-butadiene or the like.

The porous cell diameter of the conductive open-cell foam rubber roller element $\mathbf{38}c_2$ may be more than twice the average diameter of toner particles as long as the penetration of the toner particles to the open-cell foam structure thereof. For example, it is possible to obtain the open-cell foam structure wherein the porous cells are in communication with each other through fine passages or holes existing thereamong. In this case, even though the a diameter of the porous cells is more than twice the average diameter of the toner particles, by giving a diameter less than twice the toner particle diameter to the fine passages or holes communicating the porous cells with each other, it is possible to prevent the penetration of the toner particles to the roller element.

Figure 3:
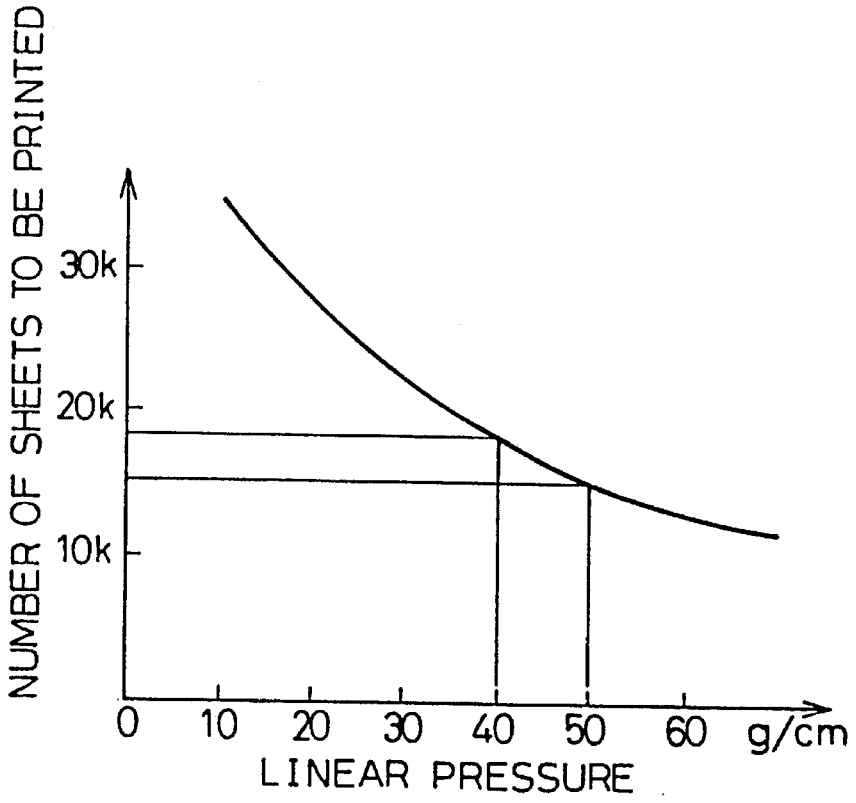
FIG. 3 is a graph showing a relationship between a linear pressure at which the conductive open-cell foam rubber developing roller is pressed against the photosensitive drum and a maximum number of sheets which can be printed by the photosensitive drum.
Figure 4:
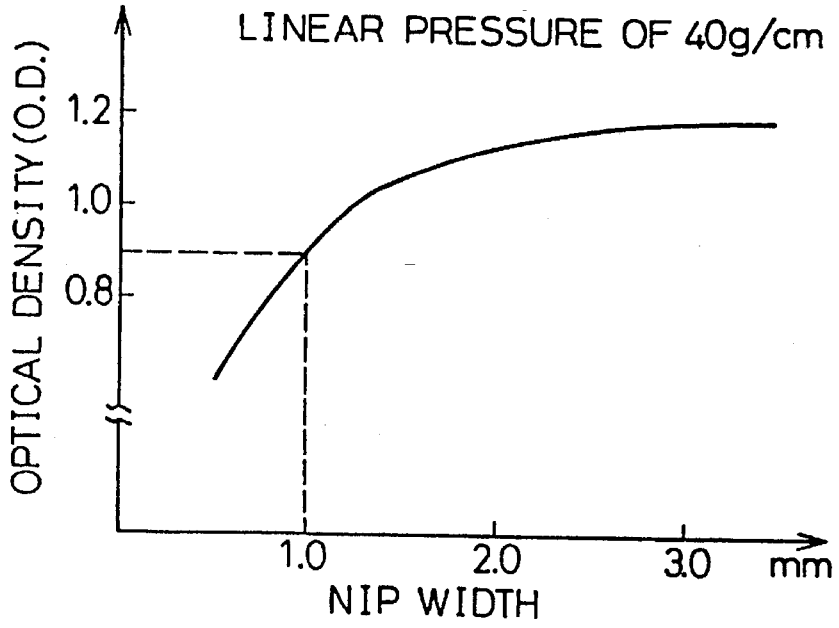
FIG. 4 is a graph showing a relationship between an optical density (O.D.) of a developed image and a contact or nip width between the conductive open-cell foam rubber developing roller and the photosensitive drum.
Figure 5:
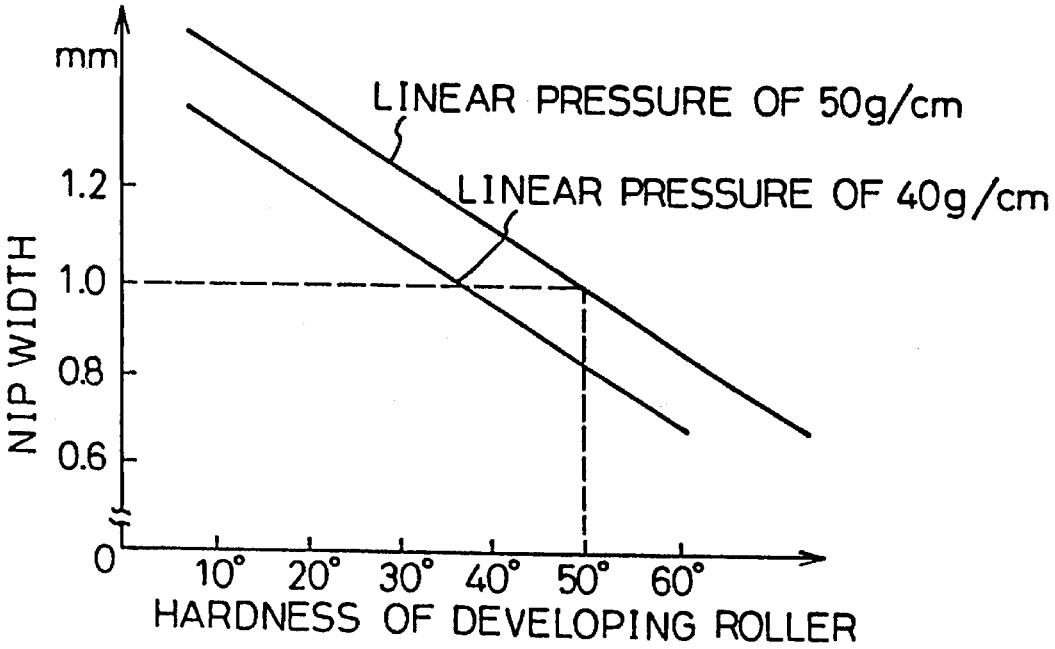
FIG. 5 is a graph showing a relationship between a hardness of the conductive open-cell foam rubber developing roller and a nip width between the open-cell foam rubber developing roller and the photosensitive drum.

According to yet another feature of the present invention, the open-cell foam rubber developing roller 38*c* is given an Asker C-hardness of at most 50°, preferably 10° to 35°, and this is possible due to the open-cell foam structure thereof. Note, the conventional solid rubber developing roller has an Asker hardness of 58°. As discussed hereinbefore, the harder the developing roller, the greater the wear of the photosensitive drum, whereby the operating life of the drum is shortened. As shown in FIG. 3, the higher the linear pressure at which the developing roller is pressed against the drum, the lower the number of sheets which can be printed by the drum. For example, when the drum is required to withstand a printing of more than 15,000 sheets, the developing roller must be pressed against the drum at a linear pressure of at most 50 g/cm. On the other hand, as shown in FIG. 4, the larger a contact or nip width between the developing roller and the drum, the higher an optical density (O.D.) of the developed image. For example, when the developing roller is pressed against the drum at a linear pressure of 40 g/cm, the nip width therebetween must be at least 1 mm before an optical density of more than about 0.9, necessary for the proper development of the latent image, can be obtained. Note, a nip width of more than 1.5 mm is preferable for carrying out the development of the latent image with a sufficient optical density. Also, as shown in FIG. 5, the lower the hardness of the developing roller, the larger the nip width between the developing roller and the drum. For example, when a developing roller having an Asker C-hardness of 50° is pressed against the drum at a linear pressure of 50 g/cm, the nip width therebetween is 1 mm, whereas when a developing roller having an Asker C-hardness of 40° is pressed against the drum at the same linear pressure, the nip width therebetween is 1.1 mm. Accordingly, the Asker C-hardness of the developing roller should be at most 50°, to enable the photosensitive drum to print more than 15,000 sheets. Note, preferably a developing roller having an Asker C-hardness of less than 35° is pressed against the drum in such a manner that the nip width therebetween is from 1 to 3.5 mm.

Figure 6:
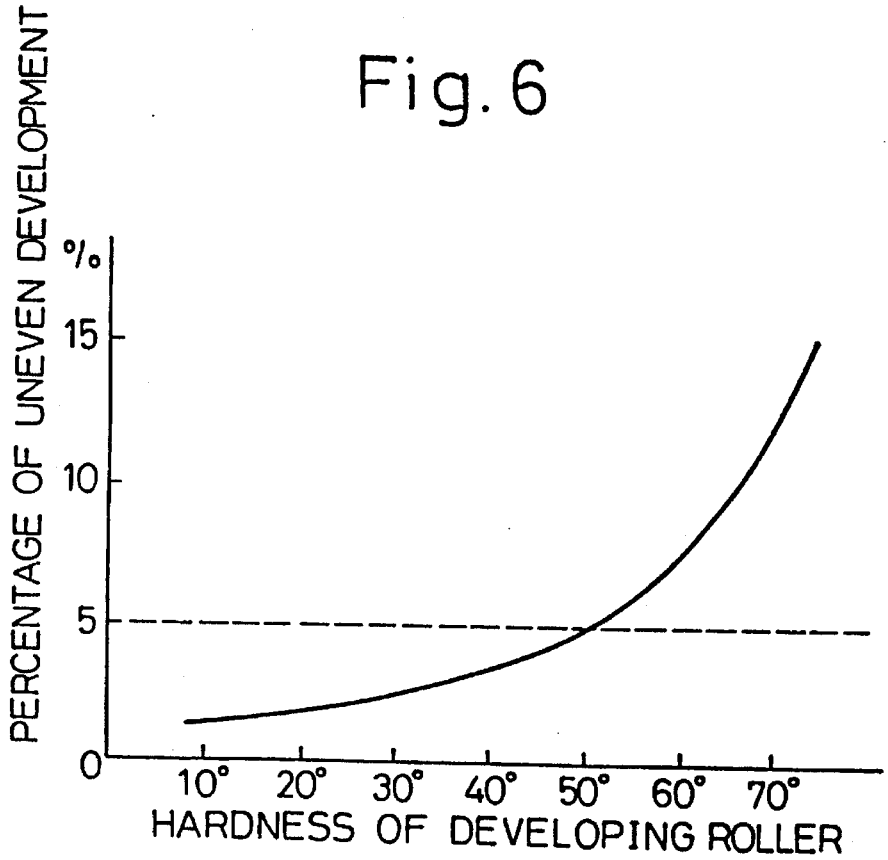
FIG. 6 is a graph showing a relationship between a hardness of the conductive open-cell foam rubber developing roller and a percentage of uneven development.
Figure 7:
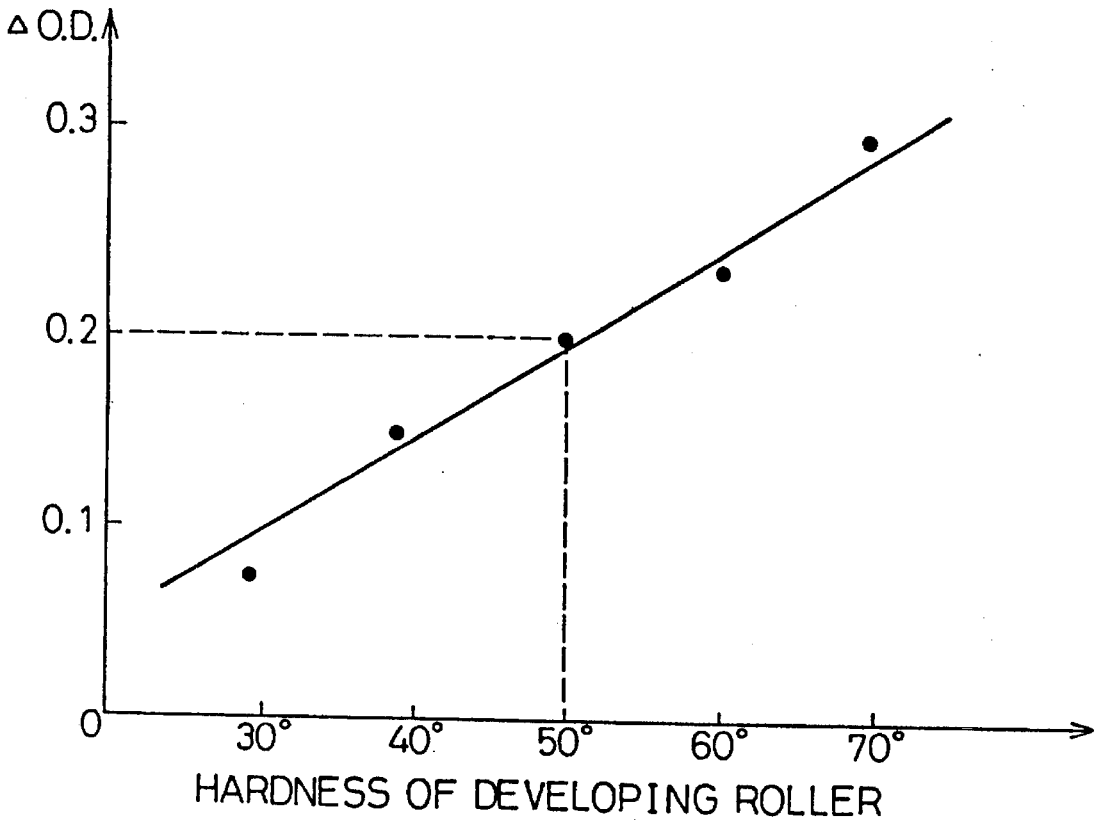
FIG. 7 is a graph showing a relationship between a hardness of the conductive open-cell foam rubber developing roller and a difference between the highest and lowest optical densities when printing a sheet solidly with a black developer.

Also, when the blade member 38*d* is made of a metal such as aluminum, stainless steel, brass or the like, the developing roller 38*c* should be given an Asker C-hardness of at most 50°. The metal blade member has a treated and finished surface which is engaged with the developing roller to regulate the thickness of the developer layer formed therearound. In general, a possible accuracy of the finished surface of the metal blade member is on the order of about 30 μm, but this may be rough relative to toner particles having an average diameter of 10 μm, so that the regulated thickness of the developer layer is made uneven due to the rough surface of the metal blade member, to thereby cause an uneven development of the latent image. The greater the hardness of the developing roller, the greater the variation of the developer thickness, and thus the uneven development becomes more noticeable as shown in FIG. 6. In this drawing, the abscissa shows a hardness of the developing roller, and the ordinate shows a percentage of uneven development when a sheet is printed solidly with a black developer. For example, if an uneven development of at most 0.5%, which is not visually noticeable, is permissible, as indicated by a broken line in FIG. 6, the developing roller must have an Asker C-hardness of at most 50°. Also, FIG. 7 shows a relationship between a hardness of the developing roller and a difference (Δ O.D.) between the highest and lowest optical densities when printing a sheet solidly with a black developer. Similarly, the difference of 0.2 (Δ O.D.), which is not visually noticeable, corresponds to the Asker C-hardness of about 50°, as indicated by broken lines in FIG. 7.

In general, a hardness of the synthetic rubber material, such as a polyurethane rubber material, upon which the open-cell foam rubber developing roller according to the present invention and the conventional solid rubber developing roller as mentioned above may be based, is made greater by a drop in temperature and air moisture content. Also, a coefficient of friction of the synthetic rubber material such as a polyurethane rubber material is lowered by a drop in temperature and air moisture content. As a result, when using a solid rubber developing roller, a toner density for the development is lowered according to a drop in temperature and air moisture content, because the toner particles cannot be sufficiently entrained by the solid rubber developing roller, and an electrophotographic fog appears because the toner particles cannot be firmly held by the solid rubber developing roller.

Figure 8:
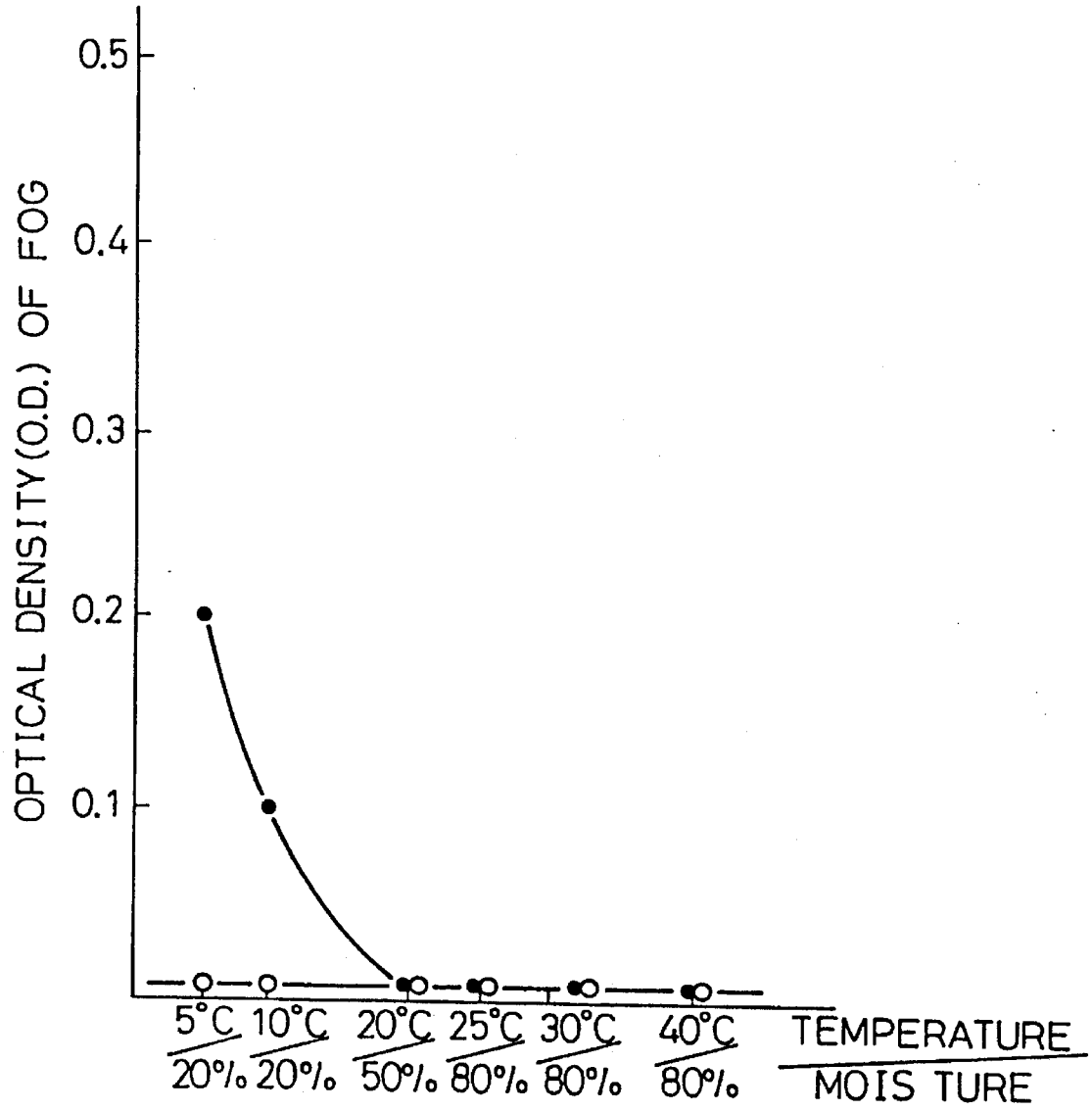
FIG. 8 is a graph showing a relationship between a variation of time temperature and air moisture content and an optical density (O.D.) of an electrophotographic fog appearing when using the conductive open-cell foam rubber developing roller having an Asker hardness of 20° and the solid rubber developing roller having an Asker hardness of 58°.

On the contrary, regardless of a drop in temperature and air moisture content, the hardness of the open-cell foam rubber developing roller cannot be greatly lowered because of the open-cell foam structure thereof, and the toner particles are easily captured and firmly held by the pore openings appearing over the surface of the open-cell foam rubber developing roller. Thus, not only can the electrophotographic fog be substantially eliminated, but also the toner density can be maintained, even though the temperature and air moisture contents are lower. FIG. 8 shows a relationship between a variation of temperature and air moisture content and an optical density (O.D.) of an electrophotographic fog when using a porous rubber developing roller having an Asker hardness of 20° and a solid rubber developing roller having an Asker hardness of 58°. Note, in FIG. 8, open circles and solid circles correspond to the open-cell foam rubber developing roller having an Asker hardness of 20° and the solid rubber developing roller having an Asker hardness of 58°, respectively. As apparent from FIG. 8, when the open-cell foam rubber developing roller having an Asker hardness of 20° was used, the electrophotographic fog was substantially eliminated even though the temperature and air moisture contents were lower, whereas when the solid rubber developing roller having an Asker hardness of 58° was used, an optical density of the electrophotographic fog was gradually increased when the temperature and air moisture content fell below 25° C. and 50%, respectively.

Figure 9:
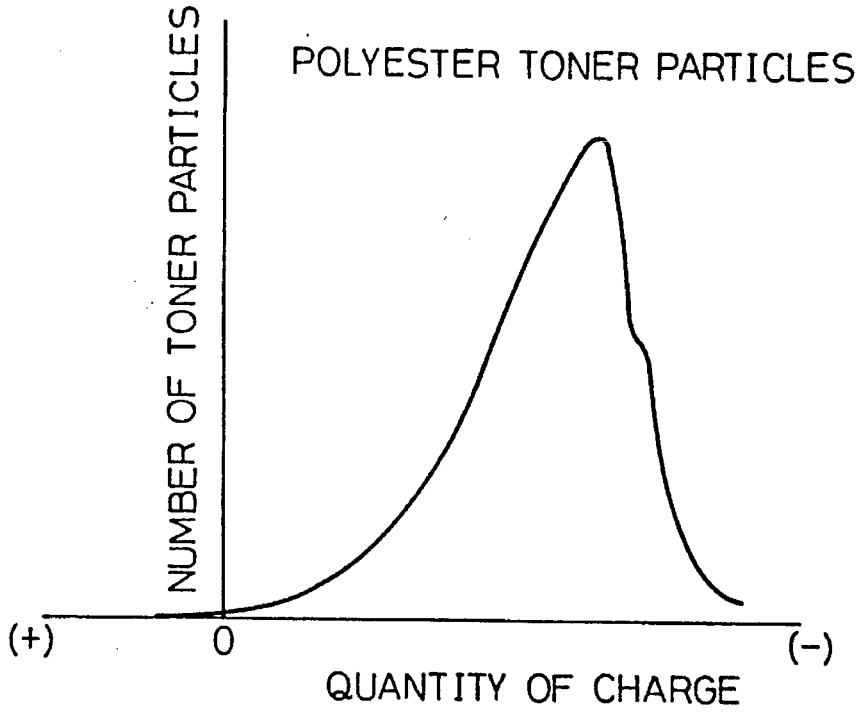
FIG. 9 is a graph showing a charge distribution of polyester resin-based toner particles when charged by using a conductive open-cell foam polyurethane rubber developing roller.
Figure 10:
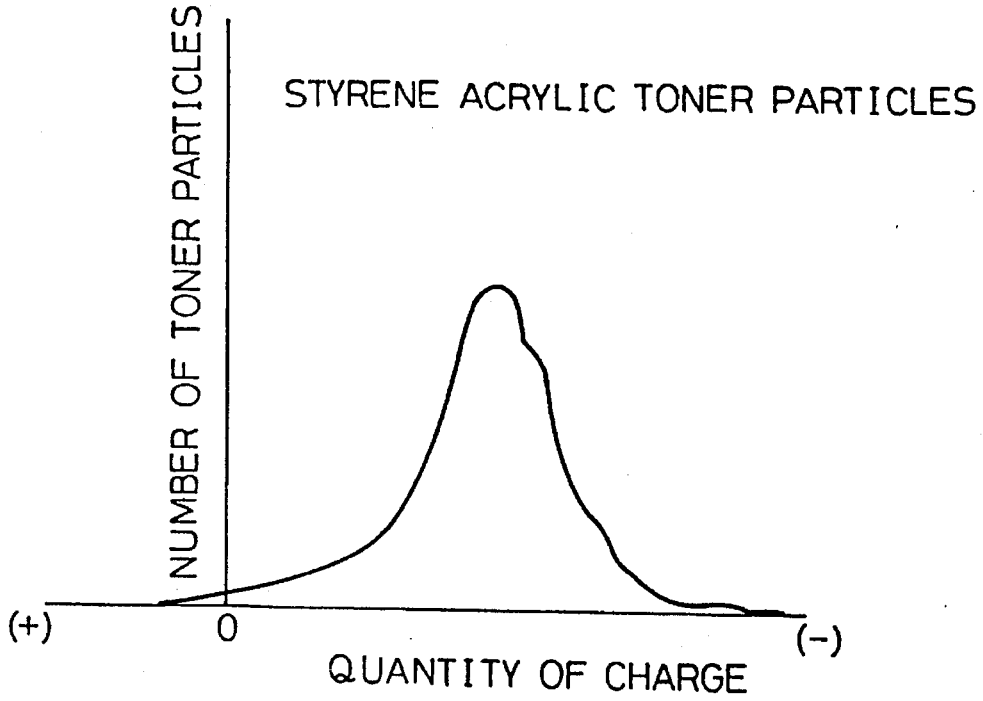
FIG. 10 is a graph showing a charge distribution of styrene acrylic resin-based toner particles when charged by using the conductive open-cell foam polyurethane rubber developing roller.
Figure 11:
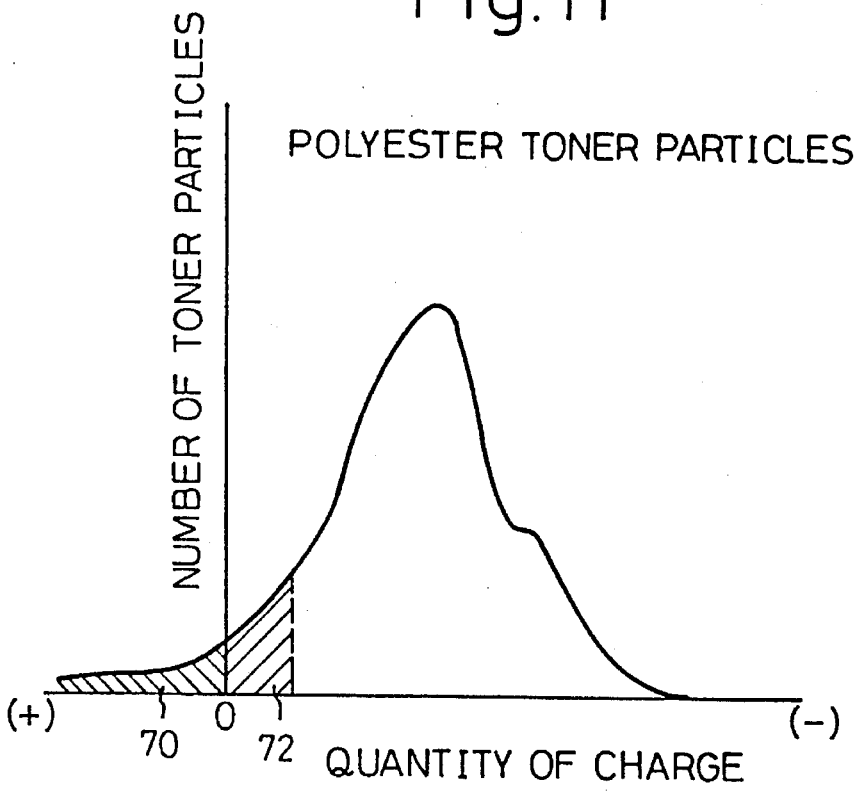
FIG. 11 is a graph showing a charge distribution of the polyester resin-based toner particles when charged by using a conductive open-cell foam silicone rubber developing roller.
Figure 12:
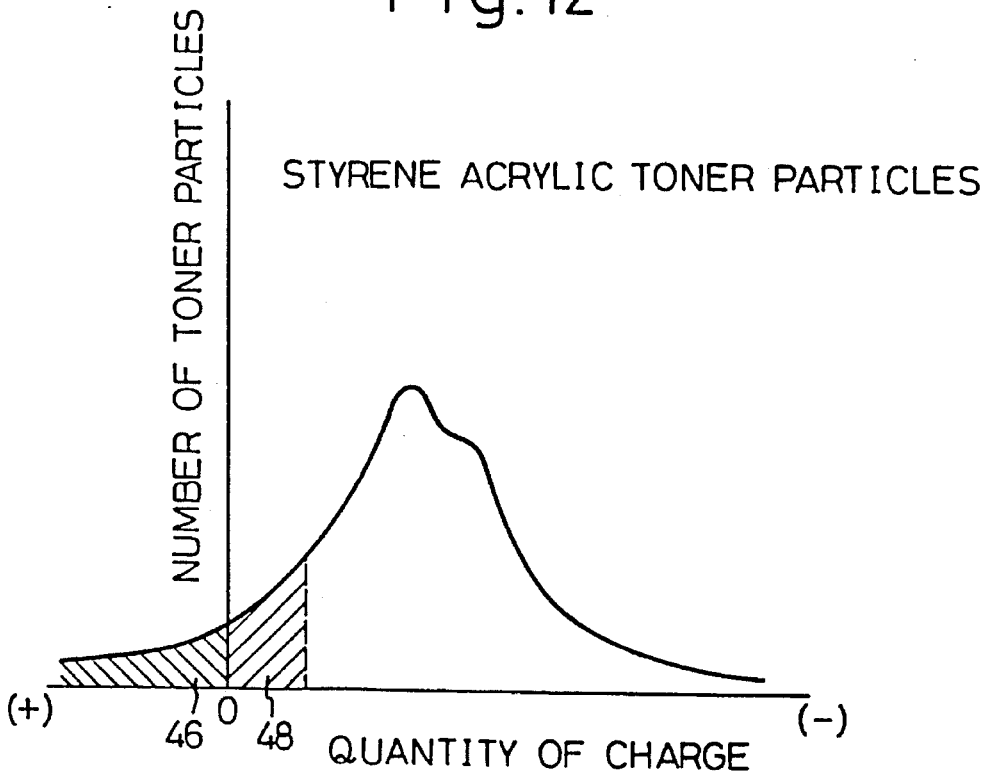
FIG. 12 is a graph showing a charge distribution of the styrene acrylic resin-based toner particles when charged by using the conductive open-cell foam silicone rubber developing roller.

According to yet another feature of the present invention, when a triboelectrification between the developing roller and the toner particles is utilized for charging the toner particles, as a rubber material for the roller element 38$c_2$ of the developing roller 38*c*, a polyurethane rubber material is used. This is because the toner particles charged by using the polyurethane foam rubber developing roller can be given a charge distribution that ensures a proper development of a latent image. For example, when the photosensitive drum is formed of the organic photoconductor (OPC), the polyester or styrene acrylic resin-based developer is used so that the toner particles thereof are given a negative charge. FIG. 9 shows a charge distribution of the polyester resin-based toner particles when charged while using the polyurethane foam rubber developing roller, and FIG. 10 shows a charge distribution of the styrene acrylic resin-based toner particles when charged while using the polyurethane foam rubber developing roller. Further, FIG. 11 shows a charge distribution of the polyester resin-based toner particles when charged while using the silicone foam rubber developing roller, and FIG. 10 shows a charge distribution of the styrene acrylic resin-based toner particles when charged while using the silicone foam rubber developing roller. Note, in each of FIGS. 9, 10, 11 and 12, the abscissa and the ordinate indicate a quantity of charge and a number of toner particles, respectively. As apparent from these drawings, when the polyurethane foam rubber developing roller is used, the polyester resin-based and styrene acrylic resin-based developers substantially do not contain toner particles having a positive charge, whereas when using the silicone foam rubber developing roller is used, the polyester resin-based and styrene acrylic resin-based developers contain not only a positively-charged part of the toner particles indicated by reference numeral 70, but also a low-level negatively-charged part of the toner particles indicated by reference numeral 72. This is assumed to be because the polyurethane foam rubber developing roller is neutral with regard to frictional electrification, whereas the silicone foam rubber developing roller is positive-high with regard to frictional electrification. In particular, the silicone foam rubber developing roller may be overcharged because of the positive high characteristics thereof with regard to frictional electrification, so that an electrical discharge between the silicone foam rubber developing roller and the blade member may occur, whereby a part of the toner particle is subjected to a positive charge. Note, the charge distributions of the toner particles shown in FIGS. 11 and 12 cannot ensure a proper development of a latent image because the positively-charged toner particles and the low-level negatively-charged toner particles may adhere to the surface of the photosensitive drum, except for the latent image zones, and thus the developer is prematurely consumed. Also, although the positively-charged toner particles adhered to the photosensitive drum cannot be transferred to a sheet or paper, the low-level negatively-charged toner particles can be transferred from the photosensitive drum to the sheet or paper, thereby causing an electrophotographic fog to appear thereon. Accordingly, when the triboelectrification between the developing roller and the toner particles is utilized for charging the toner particles, the roller element of the developing roller is preferably formed of the conductive polyurethane foam rubber material.

Furthermore, when the developing roller is formed of the conductive polyurethane foam rubber material, not the conductive silicone foam rubber material, another advantage of maintaining a resolution of a developed image, and therefore a printed image, at a high level and over a long period can be obtained. Variations of the resolution were measured where the polyurethane foam rubber developing roller and the silicone foam rubber developing roller were incorporated into electrophotographic printers having a dot density of 300 dpi (dots per inch). In the measurement, a sample pattern including a plurality of dot lines spaced from each other by a line space corresponding to the dot line was repeatedly printed out on a sheet or paper, and then a reflection density DB (reflected light intensity) from the dot lines and a reflection density DW (reflected light intensity) from the line spaces were determined from the printed sample pattern. The resolution was evaluated by a percentage R obtained from the following formula:

$$R = \frac{\sum_{i=1}^{n} DW_i/n}{\sum_{i=1}^{n} DB_i/n} \times 100(\%)$$

Figure 13:
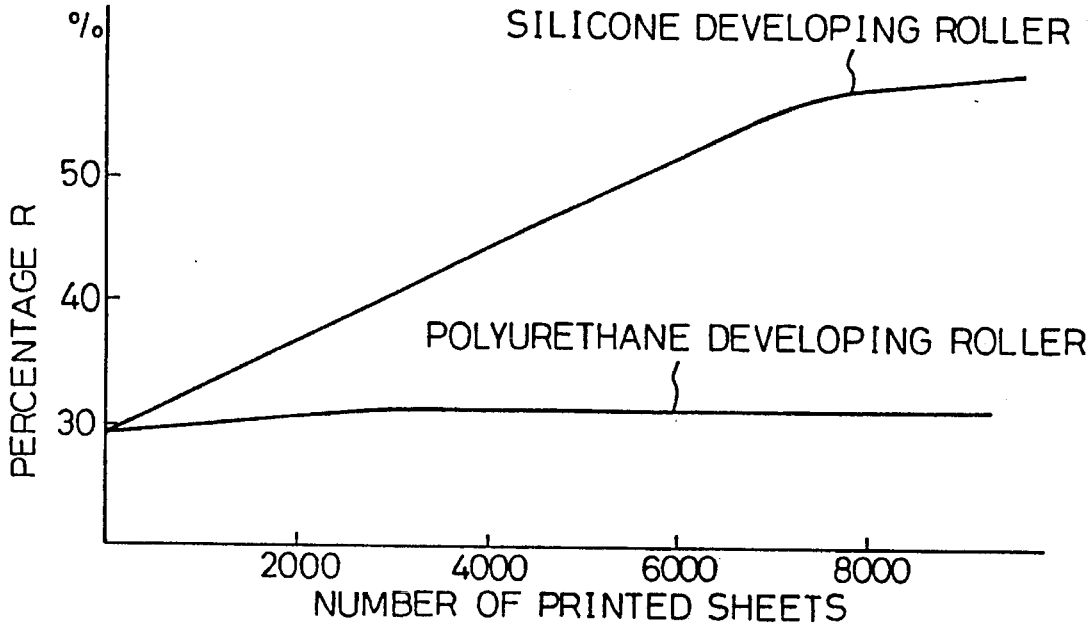
FIG. 13 is a graph showing how a resolving power of a developed image varies as a number of printed sheets is increased, when using the conductive open-cell foam polyurethane rubber developing roller and the conductive open-cell foam silicone rubber developing roller.

Herein: "n" indicates a number of dot lines or line spaces. As apparent from this formula, the smaller the percentage R, the greater the resolution. Note, when the percentage R exceeds 60%, the resolution derived therefrom is practically unacceptable. The results of this measurement are shown in FIG. 13, and as shown in this drawing, when the polyurethane foam rubber developing roller is used, the percentage R is constantly maintained at 30% throughout a printing of more than 8,000 sheets, whereas when the silicone foam rubber developing roller is used, the percentage R is raised to the limit of 60% when the number of printed sheets reaches about 8,000. This is assumed to be because the polyurethane foam rubber developing roller has a superior wear resistance to the silicone foam rubber developing roller, whereby a surface characteristic of the silicone foam rubber developing roller is easily deteriorated by the frictional engagement with the photosensitive drum and the blade member, in comparison with the polyurethane foam rubber developing roller.

According to yet another feature of the present invention, the developing roller and the blade member are constituted in such a manner that the work functions thereof are smaller or larger than that of the developer. When the triboelectrification between the developing roller and blade member and the toner particles is utilized for charging the toner particles, these work functions should be smaller or larger than that of the developer, as this enables the charged toner particles thereof to be given a charge distribution by which a proper development of a latent image is obtained. Note, this feature of the present invention can be applied to a developing device including a developing roller formed of a solid rubber material.

Figure 14:
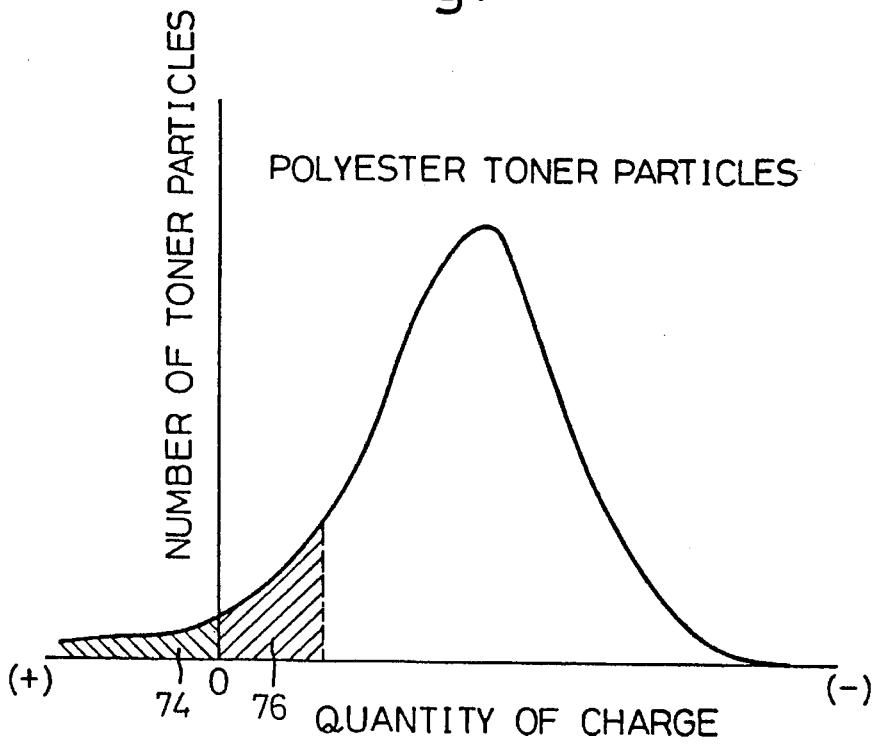
FIG. 14 is a graph showing a charge distribution of the polyester resin-based toner particles when charged by a triboelectrification while using the conductive open-cell foam polyurethane rubber developing roller and a Teflon-coated rubber blade member.
Figure 15:
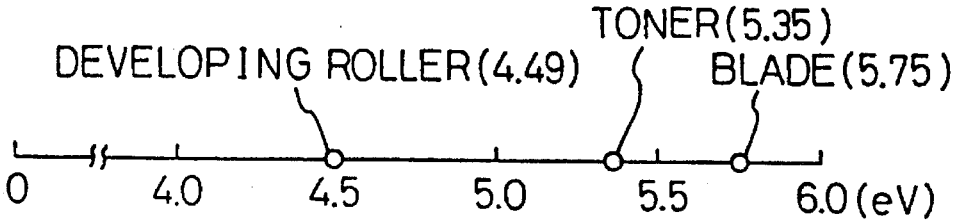
FIG. 15 is a work function scale for comparing the work functions of the conductive open-cell foam polyurethane rubber developing roller, the Teflon-coated rubber blade member, and the polyester resin-based toner particles.

For example, when the polyester resin-based toner particles are charged by using the developing roller formed of the conductive polyurethane foam rubber material and the blade member formed of the Teflon-coated rubber material, the charged polyester resin-based toner particles are given a charge distribution as shown in FIG. 14, which is similar to the charge distribution of FIG. 11. Namely, the polyester resin-based developer charged by using the polyurethane foam rubber developing roller includes a positively-charged part of the toner particles indicated by reference numeral 74, and a low-level negatively-charged part of the toner particles indicated by reference numeral 76. This is assumed to be because a work function of the Teflon-coated rubber blade member is larger than that of the polyester resin-based toner particles, and thus even though the toner particles are negatively charged by the polyurethane foam rubber developing roller, the negative charge of the toner particles is weakened by the blade member having a work function smaller than that of the toner particles, whereby a part of the toner particles can be given a positive charge. In practice, measurements proved that the polyurethane foam rubber developing roller, the polyester resin-based toner particles, and the Teflon-coated rubber blade member have the work functions of 4.49, 5.35, and 5.75 eV, respectively, as shown in FIG. 15.

Figure 16:
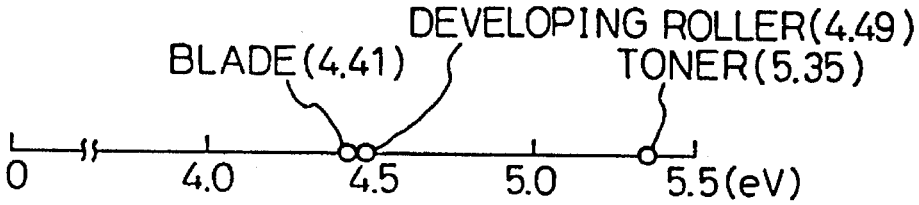
FIG. 16 is a work function scale for comparing the work functions of the conductive open-cell foam polyurethane rubber developing roller, an aluminum blade member, and the polyester resin-based toner particles.
Figure 17:
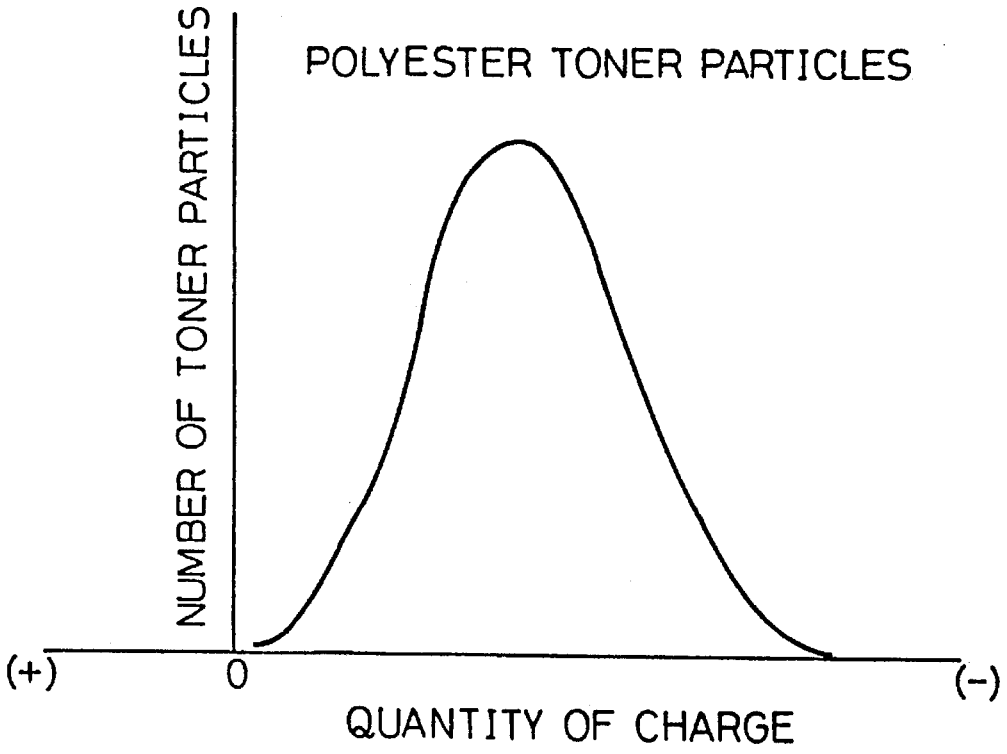
FIG. 17 is a graph showing a charge distribution of the polyester resin-based toner particles when charged by a triboelectrification while using the conductive open-cell foam polyurethane rubber developing roller and the aluminum blade member.

When the toner particles have the charge distribution as shown in FIG. 14, for the same reasons as mentioned above, the developer also may be prematurely consumed and a photographic fog may appear. Nevertheless, these disadvantages can be surmounted by forming the blade member of a metal material having a relatively small work function. For example, when the blade member is formed of aluminum having a work function of 4.41 eV, the work functions of the polyurethane foam rubber developing roller and blade member are less than that of the polyester resin-based toner particles, as shown in FIG. 16, so that the polyester resin-based toner particles can be negatively charged by the polyurethane foam rubber developing roller and the blade member. As a result, the charged polyester resin-based toner particles are given a desired charge distribution, as shown in FIG. 17.

The polyester resin-based toner particles having a work function of 5.35 eV were produced from the following raw materials:

| | |
|---|---|
| (1) polyester resin: (acid values 45; melting point 145° C.) | 93 pbw (parts by weight) |
| (2) carbon: (Black Pearls L: Cabot Corp.) | 3 pbw |
| (3) polypropylene wax: (Biscol 550P: Sanyo Kasei K.K.) | 1 pbw |
| (4) azo dye: (Aizen Spilon Black TRH: Hodogaya Chemical Corp. Lrd.) | 2 pbw |

Note, the polyester resin was obtained by a condensation of terephthalic acid, trimellitic acid, and diol having the structural formula below:

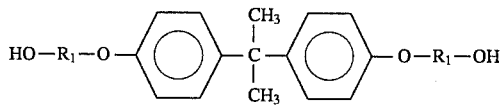

Wherein, $R_1$ is $C_nH_{2_n}$ ($1 \leqq n \leqq 5$)

In the production steps, these raw materials were mixed, fused, kneaded, and then powdered to produce fine particles having a diameter of from 5 to 15 μm.

Also, when another type of azo dye (S34: Orient Chemical K.K.) was substituted for the azo dye (Aizen Spilon Black TRH: Hodogaya Chemical Corp.Lrd.), the polyester resin-based toner particles obtained had a work function of 5.60 eV, which is larger than the work functions of the polyurethane foam rubber developing roller and the aluminum blade member.

The styrene acrylic resin-based toner particles also can be used, as long as a work function thereof is larger than the work functions of the polyurethane foam rubber developing roller and the aluminum blade member. In practice, styrene acrylic resin-based toner particles having a work function of 5.25 eV, which is larger than the work functions of the polyurethane foam rubber developing roller and the aluminum blade member, were produced by using the following raw materials:

| | |
|---|---|
| (1) styrene acrylic resin: (melting point 140° C.) | 90 pbw |
| (2) carbon: (Black Pearls L: Cabot Corp.) | 5 pbw |
| (3) polypropylene wax: (Biscol 550P: Sanyo Kasei K.K.) | 3 pbw |
| (4) azo dye: (Aizen Spilon Black TRH: Hodogaya Chemical Corp. Lrd.) | 2 pbw |

Note, the styrene acrylic resin was obtained by a copolymerization of styrene and n-butylacrylate.

In the production steps, these raw materials were mixed, fused, kneaded, and then powdered into fine particles having a diameter of from 5 to 15 μm.

Namely, when the toner particles are to be given a negative charge, the desired charge distribution can be obtained by constituting the developing roller and the blade member in such a manner that the work functions thereof are less than that of the toner particles.

On the other hand, when the toner particles are to be given the positive charge, the desired charge distribution can be obtained by constituting the developing roller and the blade member in such a manner that the work functions thereof are larger than that of the toner particles. For example, polyester resin-based toner particles having a work function of 5.35 eV or styrene acrylic resin-based toner particles having a work function of 5.25 eV can be given a positive charge by using the Teflon-coated rubber blade member having a work function of 5.75 eV and by coating the polyurethane foam rubber developing roller with Teflon to give a work S function of 5.75 eV thereto. Note, the Teflon-coating of the developing roller should be carried out in such a manner that that the pore openings existing in the surface thereof are not covered over.

According to yet another feature of the present, the developing roller and the developer are constituted in such a manner that the triboelectrification therebetween does not participate in the charging of the toner particles, as much as possible, because the triboelectrification therebetween is affected by variations in the environment, particularly, temperature and air moisture content changes, and thus although the work functions of the developing roller and the blade member are smaller or larger than that of the developer as mentioned above, the charged toner particles cannot be always given the desired charge distribution. Note, this aspect of the present invention also can be applied to a developing device including a developing roller formed of a solid rubber material.

Figure 18:
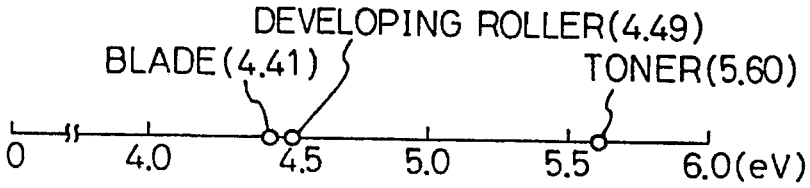
FIG. 18 is a work function scale for comparing the work functions of the conductive open-cell foam polyurethane rubber developing roller, the aluminum blade member, and another type of polyester resin-based toner particles.
Figure 19A:
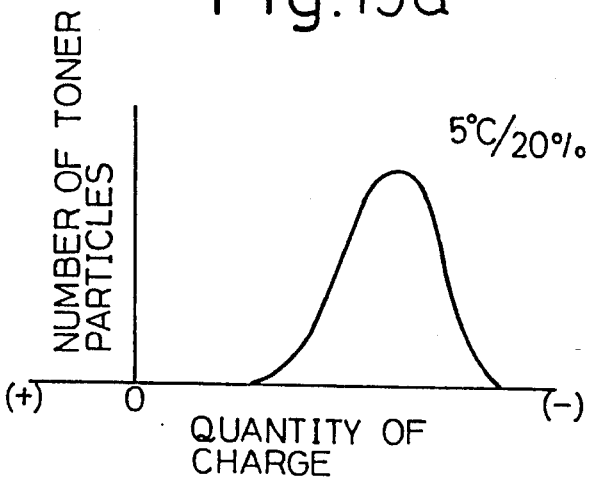
FIGS. 19(*a*), 19(*b*), and 19(*c*) are graphs showing a charge distribution of the polyester resin-based toner particles referred to in FIG. 18 when charged by a triboelectrification while using the conductive open-cell foam polyurethane rubber developing roller.
Figure 19B:
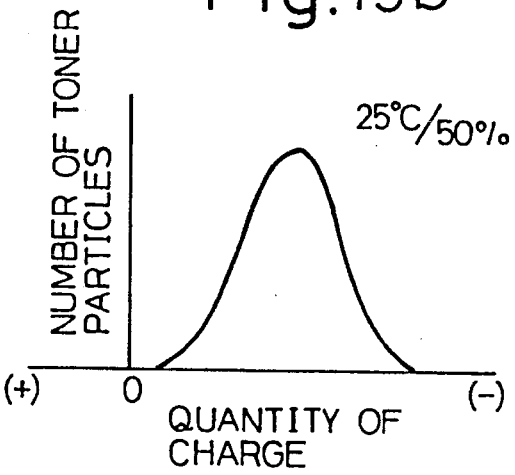
Figure 19C:
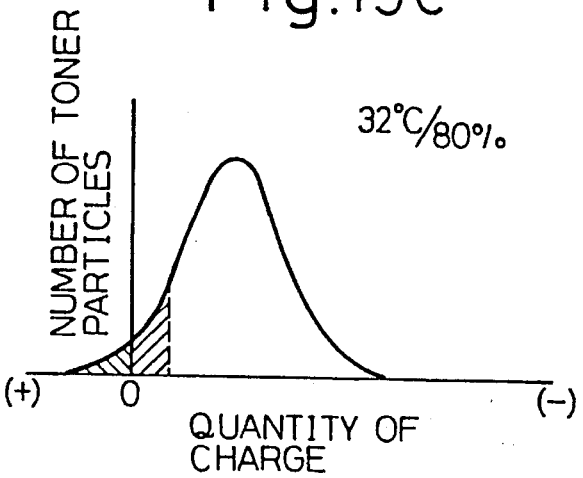

For example, when using the aluminum blade member, the polyurethane foam rubber developing roller, and the polyester resin-based toner particles, having the work functions of 4.41, 4.49, and 5.60 eV as shown in FIG. 18, a charge distribution of the toner particles is easily changed by a variation of the temperature and air moisture content, as shown in FIGS. 19(*a*), 19(*b*), and 19(*c*). Namely, when the temperature and air moisture contents are 5° C. and 20%, respectively, the toner particles are given a charge distribution as shown in FIG. 19(*a*), but when the temperature and air moisture contents are raised from 5° C. and 20% to 25% and 50%, respectively, the charge distribution of the toner particles is shifted toward the positive side, as shown in FIG. 19(*b*), and when the temperature and air moisture contents are raised to 32° C. and 80%, respectively, the charge distribution of the toner particles is further shifted toward the positive side, as shown in FIG. 19(*c*). This is assumed to be because the water contents of the developing roller and the toner particles are changeable in response to variations of the temperature and air moisture contents. The charge distributions shown in FIGS. 19(*a*) and 19(*b*) ensure a proper development of a latent image, but the charge distribution shown in FIG. 19(*c*) do not, because the toner particles include positively-charged and low-level negatively charged parts, as shown by the hatchings in FIG. 19(*c*).

Figure 20:
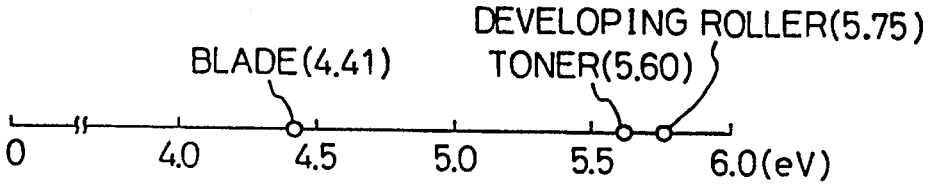
FIG. 20 is a work function scale for comparing the work functions of a Teflon-coated conductive open-cell foam polyurethane rubber developing roller, the aluminum blade member, and the polyester resin-based toner particles referred to in FIG. 18.
Figure 21A:
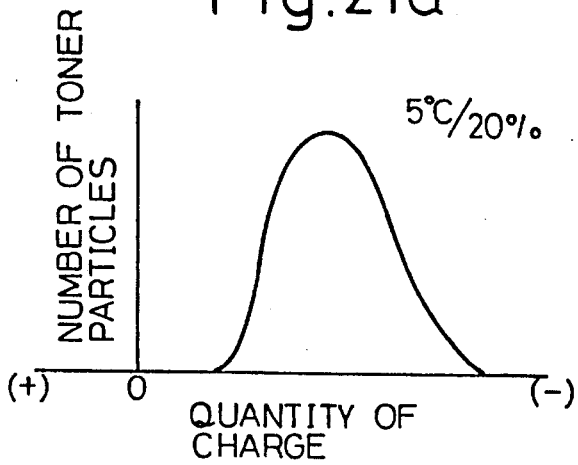
FIGS. 21(*a*), 21(*b*), and 21(*c*) are graphs showing a charge distribution of the polyester resin-based toner particles referred to in FIG. 18, when charged by a triboelectrification while using the aluminum blade member.
Figure 21B:
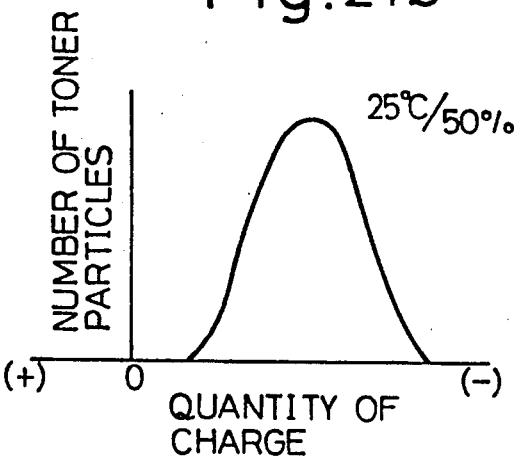
Figure 21C:
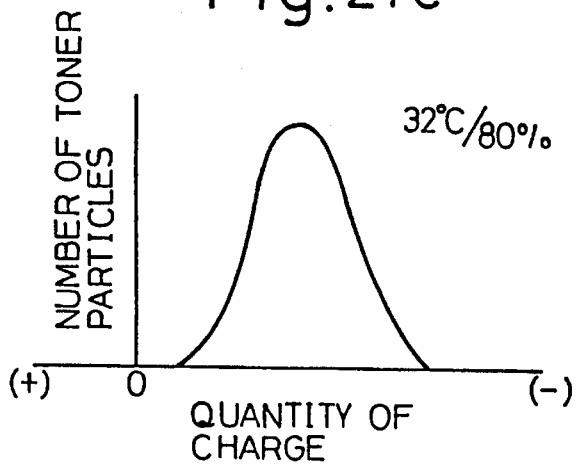

Accordingly, when the electrophotographic printer is used under high temperature and air moisture content conditions, the developing roller and the developer should be constituted in such a manner that the triboelectrification therebetween does not participate in the charging of the toner particles, as much as possible. This can be carried out by ensuring that the work functions of the developing roller and the developer conform with each other as much as possible. For example, by coating the polyurethane foam rubber developing roller with Teflon, it can be given the work function of 5.75 eV, as mentioned above, which is approximate to the work function of 5.60 eV as shown in FIG. 20. In this case, the charging of the toner particles may be actively carried out by the aluminum blade member having the work function of 4.41 eV, so that a charge distribution thereof is relatively stable regardless of variations of the temperature and air moisture content, as shown in FIGS. 21(*a*), 21(*b*), and 21(*c*). In particular, as apparent from these drawings, the charge distribution may be shifted slightly to the positive side in response to a raise in the temperature and air moisture content, but even though the temperature and air moisture contents are raised to 32° C. and 80%, respectively, the charge distribution does not include positively charged toner particles.

Furthermore, according to the present invention, the developing roller, the blade member, and the developer may be constituted in such a manner that the work functions thereof approximate to each other, whereby the triboelectrification between the developing roller and blade member and the toner particles does not participate in the charging of the toner particles, as much as possible. In this case, the charging of the toner particles is carried out by the charge-injection effect resulting from the application of a bias voltage to the conductive blade meter. For example, by coating the polyurethane foam rubber developing roller and the conductive rubber blade member with Teflon, and by using the polyester resin-based toner particles having the work function of 5.60 eV, the work functions thereof may approximate each other because the polyurethane foam rubber developing roller and the conductive rubber blade member can be given the work function of 5.75 eV by the Teflon coating, as mentioned above. When the work functions of the developing roller, the blade member, and the developer approximate each other, the charging of the toner particles can be substantially protected from the affect of variations of the temperature and air moisture contents, and thus the charge distribution of the toner particles is made more stable. Note, in practice it is possible to give a charge of $-10\pm1$ μq/g to the toner particles when a bias voltage of $-200$ V is applied to the blade member.

According to the present invention, the charge -injection effect may be utilized in cooperation with the triboelectrification for charging the toner particles. When the charge-injection effect is utilized for charging the toner particles, a difference between the bias voltage applied to the blade member and the developing bias voltage applied to the developing roller should be within a predetermined range, because when the difference is small enough to allow the electrostatical adhesion of the toner particles to the blade member, an even formation of the developer layer around the developing roller may not be possible, and because when the difference is large enough to cause a high electrical current or an electrical discharge between the blade member and the developing roller, not only the toner particles but also the developing roller may be fused due to generation of Joule heat. For example, when the polyurethane foam rubber developing roller, the aluminum blade member, and the polyester resin based toner particles are used, the difference between the bias voltage applied to the blade member and the developing bias voltage applied to the developing roller should be within the range of from $-20$ to $-200$ volts, as shown in the following table.

| Voltage of Blade | Voltage Difference between Blade and Roller | Changes at Roller | Changes at Blade |
|---|---|---|---|
| −650 V | −350 V | Recesses Formed in Roller Surface by Fusion | Fused Toner Adhered to Blade |
| −600 V | −300 V | Fused Toner Adhered Like Film to Roller: Developing Density Lowered | None |
| −550 V | −250 V | Fused Toner Adhered Like Film to Roller: Developing Density Lowered | None |
| −500 V | −200 V | Fused Toner Slightly Adhered Like Film to Roller: Developing Density Not Lowered | None |
| −450 V | −150 V | Fused Toner Slightly Adhered Like Film to Roller: Developing Density Not Lowered | None |
| −400 V | −100 V | None | None |
| −370 V | −70 V | None | None |
| −350 V | −50 V | None | None |
| −330 V | −30 V | None | None |
| −320 V | −20 V | None | None |
| −310 V | −10 V | None | Toner Electrostatically Adhered to Blade |
| −300 V | 0 V | None | Toner Electrostatically Adhered to Blade |

As apparent from the table, when the voltage difference is more than −350 volts, not only the toner particles but also the developing roller are fused due to the discharge between the blade member and the developing roller, so that recesses are formed in the surface thereof. When the voltage difference is between −300 and −250 volts, the formation of the recesses can be prevented at the surface of the developing roller, but the fused toner particles are adhered like a film to the surface thereof so that the toner density of the development is lowered. When the voltage difference is between −200 and −150 volts, the fused toner particles are slightly adhered like a film to the surface of the developing roller, but the toner density of the development is not substantially affected thereby. When the voltage difference is less that −10 volts, the toner particles are electrostatically adhered to the blade member. Accordingly, when the polyurethane foam rubber developing roller, the aluminum blade member, and the polyester resin based toner particles are used, the voltage difference should be from −20 to −200 volts, preferably from −20 to −100 volts.

Figure 22:
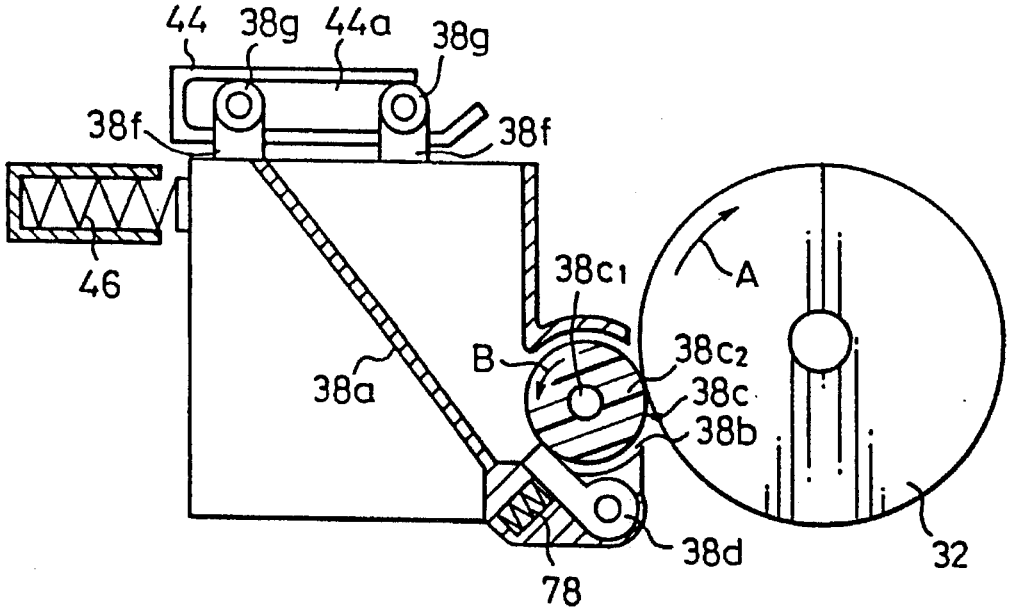
FIG. 22 is a schematic view showing a modification of the developing device shown in FIG. 2.

FIG. 22 shows a modification of the embodiment of FIG. 2. In this modified embodiment, the blade member 38*d* is resiliently biased against the developing roller 38*c* by a coil spring element 78 which is received in a recess formed in a bottom wall of the hopper 38*a*.

Figure 23:
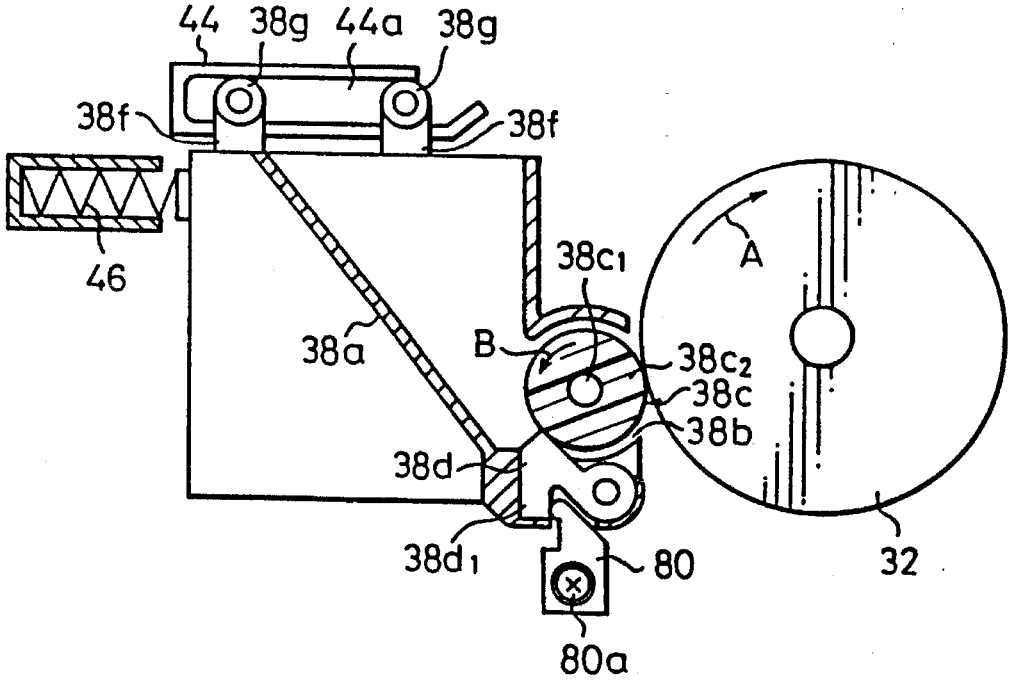
FIG. 23 is a schematic view showing another modification of the developing device shown in FIG. 2.

FIG. 23 shows another modification of the embodiment of FIG. 2. In this modified embodiment, the blade member 38*d* has an extension $\mathbf{38}d_1$ downwardly projected from a free end thereof. The extension $\mathbf{38}d_1$ is engaged with a cam element 80 which is pivoted on a shaft 80*a* supported by the printer frame, and which is resiliently biased in the counterclockwise direction in FIG. 23 by a torsion spring (not shown) incorporated in the shaft 80*a*, whereby the blade member 38*d* is resiliently biased against the developing roller 38*c*.

Figure 24:
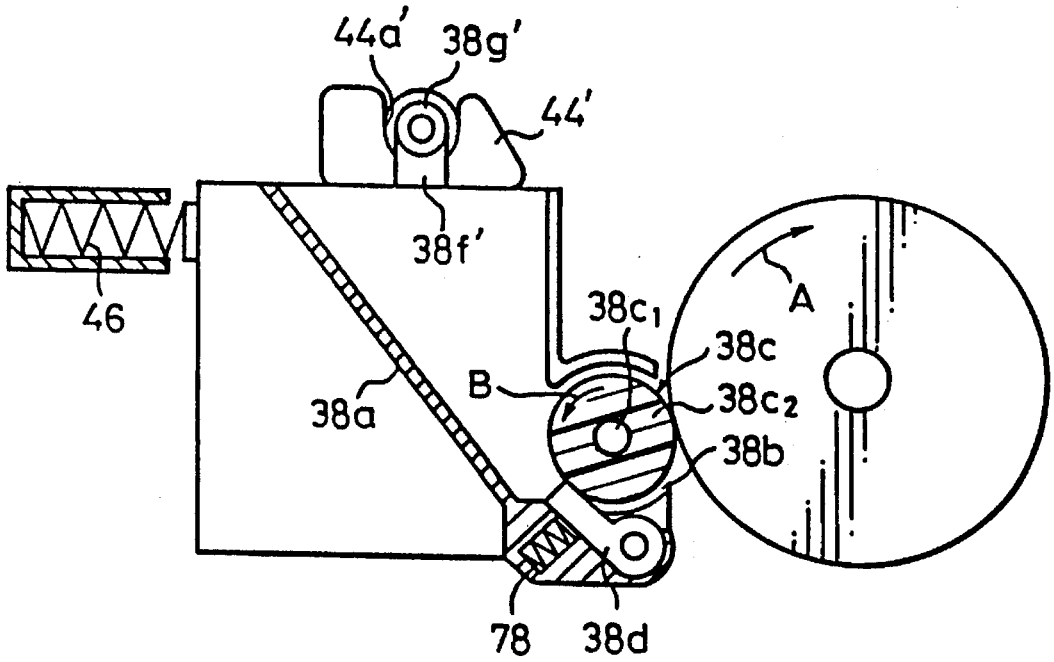
FIG. 24 is a schematic view showing a modification of the developing device shown in FIG. 22.

FIG. 24 shows a modification of the embodiment of the FIG. 22. In this modified embodiment, the frame casing of the developing device 38 is pivotally suspended from a support member 44' fixed to the printer frame and having a recess 44*a'* formed therein. In particular, the frame casing of the developing device 38 has a tongue piece 38*f'* upwardly projected from the top wall thereof and having a roller element 38*g'* rotatably attached to a free end of the tongue piece 38*f'*. The frame casing of the developing device 38 is pivotally suspended by receiving the roller element 38*g'* in the recess 44*a'* of the support member 44', so that the frame casing is movable toward and away from the photosensitive drum 32.

Figure 25:
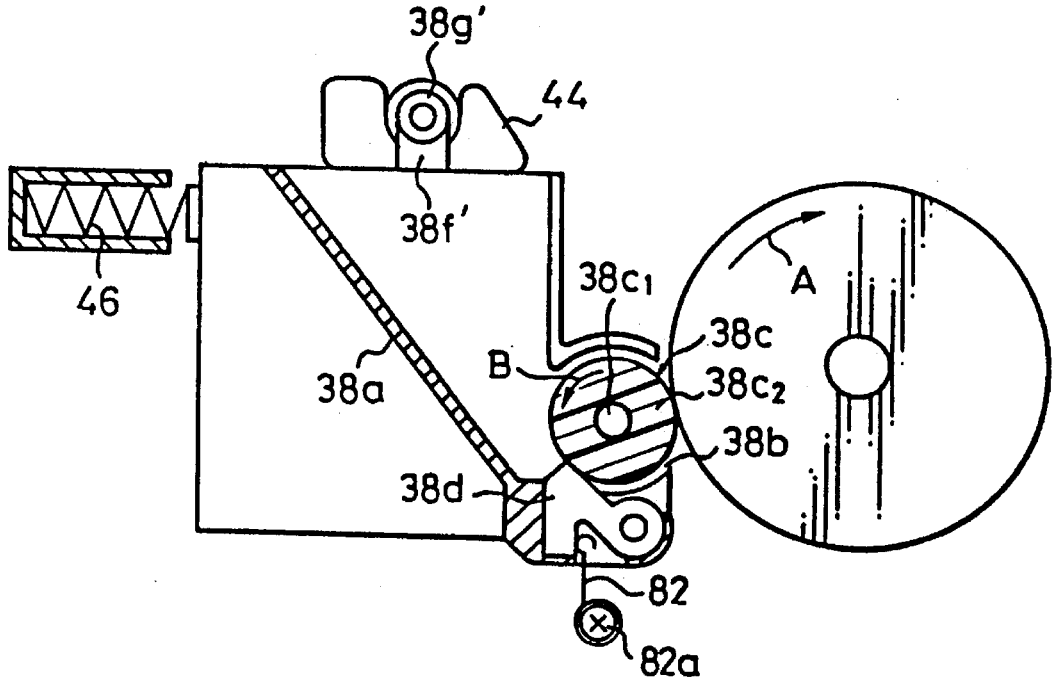
FIG. 25 is a schematic view showing a modification of the developing device shown in FIG. 24.

FIG. 25 is a modification of the embodiment of FIG. 24. In this modified embodiment, the blade member 38*d* is formed in the same manner as in FIG. 23, i.e., has the extension 38*d*, downwardly projected from the free end thereof. The extension $\mathbf{38}d_1$ is engaged with a leaf spring 82 which is fixed to a shaft 82*a* supported by the printer frame, and which is resiliently biased in the counterclockwise direction in FIG. 25, whereby the blade member 38*d* is resiliently biased again at the developing roller 38*c*.

Figure 26:
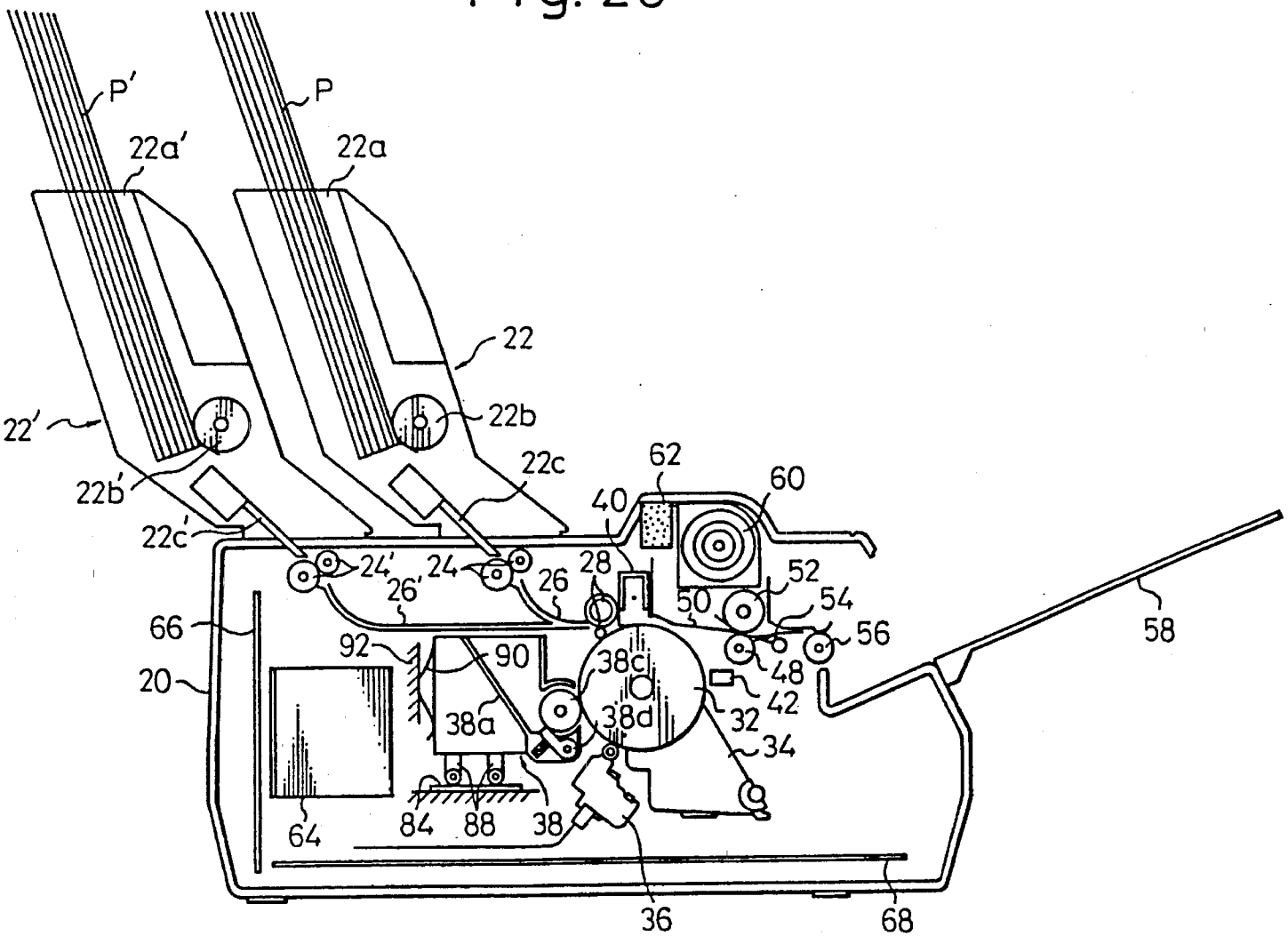
FIG. 26 is a schematic view showing a modification of the electrophotographic printer shown in FIG. 1.

FIG. 26 shows an modification of the embodiment of the electrophotographic printer shown in FIG. 1. This modified printer is provided with an additional cut sheet feeder 22' including a hopper 22*a'* in which cut sheets or papers P' are held, a feed roller 22*b'* for drawing out the cut sheets or papers P' one by one from the hopper 22*a*, and a guide plate 22*c'* for feeding the drawn paper into the housing 20 through a slot formed in the top wall thereof. A pair of delivery rollers 24' is disposed within the housing 20 and adjacent to the guide plate 22*c'*, and a guide 26' joins the guide 26. The additional cut sheet feeder 22' is operated in the same manner as the cut sheet feeder 22. Although, the cut sheets P held in the hopper 22*a* preferably have a size (for example, B5 size) different from that (for example, A4 size) of the cut sheets P' held in the hopper 22*a'*, the cut sheets P and P' may have the same size.

Figure 27:
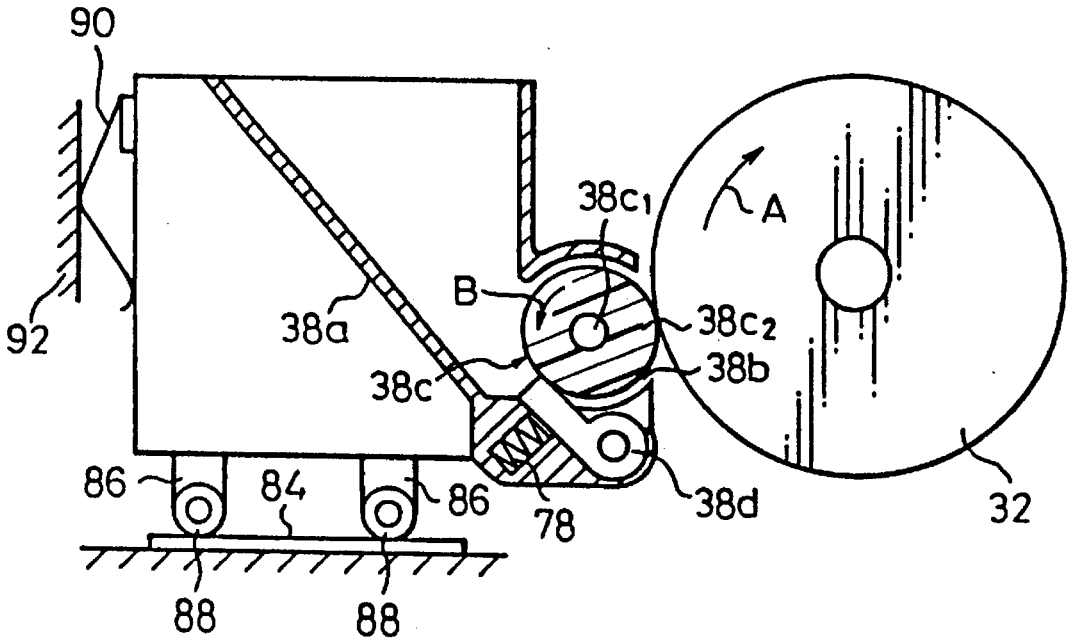
FIG. 27 is an enlarged schematic view of the developing device used in the electrophotographic printer of FIG. 26.

In the modified printer of FIG. 26, since an upper space of the housing 20 is occupied by the guide 26', the support member 44 is omitted therefrom. Instead, as best shown in FIG. 27, a pair of guide rails 84 (only one thereof illustrated in FIG. 27) is provided below the developing device 38. On the other hand, the frame casing of the developing device 38 has two pair of tongue pieces 86 which are downwardly projected from a bottom wall thereof, and each of which has a guide roller element 88. The frame casing of the developing device 38 is mounted on the guide rails 84 through the guide roller elements 88, whereby the frame casing is movable toward and away from the 20 photosensitive drum 32. Also, as best shown in FIG. 27, a leaf spring 90 is provided between a fixed wall portion 92 of the printer frame and a rear wall of the frame casing of the developing device 38, so that the developing roller 38*c* is resiliently pressed against the drum 32. Note, in the developing device 38 shown in FIGS. 26 and 27, the blade member 38*d* is resiliently biased in the same manner as in the embodiments of FIGS. 22 and 24.

In the above-mentioned embodiments, the photosensitive drum 32 may be rotated in a direction indicated by an arrow A' in FIG. 1, if necessary, so that the surface thereof moves downward at the developing area. In this case, of course, the arrangement of the elements forming the essential part 30 of the printer is varied according to the rotational direction A' of the drum 32.

Also, in the above-mentioned embodiments, although the bottom wall of the vessel or hopper 38*a* for holding the developer forms a steep slope descending toward the developing roller 38*c*, so that the toner particles can be moved thereto by the force of gravity, the bottom wall of the hopper 38*a* may have gentle slope. In this case, the vessel 38*a* is preferably provided with a paddle roller for positively moving the toner particles toward the developing roller 38*c* and/or an agitator for agitating the toner particles to eliminate a dead stock thereof from the vessel 38*a*.

The tangential arrangement of the developer layer regulating means with respect to the moving surface of the developing roller is shown in FIGS. 2(*a*), 22, 23, 24, 25 and 27.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-component developer may be also used, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer;

said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound; and said developing roller having an Asker C-hardness of at most 50°, and is resiliently pressed against the surface of said electrostatic latent image carrying body, whereby the operating life of said electrostatic latent image carrying body can be prolonged.

2. A developing device as set forth in claim 1, wherein said developing roller has an Asker C-hardness of at most 50°, preferably 35°, and said developer layer regulating means is formed of a metal, whereby variations of the developer layer thickness regulated by said developer layer regulating means can be reduced.

3. A developing device as set forth in claim 1, wherein said conductive open-cell foam rubber material of which said developing roller is formed is a conductive open-cell foam polyurethane rubber material, whereby a resolution of a developed image can be maintained at a high level and over a long period.

4. A developing device as set forth in claim 1, wherein said conductive open-cell foam rubber material of which said developing roller is formed is a conductive open-cell foam polyurethane rubber material which is neutral with regard to frictional electrification, whereby the toner particles can be given a desired charge distribution by utilizing a triboelectrification between said developing roller and the toner particles.

5. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer;

wherein said developing roller is constituted so that a work function thereof approximates, preferably conforms with, that of the toner particles, and the toner particles are charged by a triboelectrification between said developer layer regulating means and the toner particles, whereby the toner particles can be given a desired charge distribution regardless of variations of temperature and air moisture contents.

6. A developing device as set forth in claim 5, wherein said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound.

7. A developing device as set forth in claim 6, wherein said developing roller has an Asker C-hardness of at most 50°, preferably 35°, and is resiliently pressed against the surface of said electrostatic latent image carrying body, whereby the operating life of said electrostatic latent image carrying body can be prolonged.

8. A developing device as set forth in claim 6, wherein said developing roller has an Asker C-hardness of at most 50°, preferably 35°, and said developer layer regulating means is formed of a metal, whereby variations of the developer layer thickness regulated by said developer layer regulating means can be reduced.

9. A developing device as set forth in claim 6, wherein said conductive open-cell foam rubber material of which said developing roller is formed is a conductive open-cell foam polyurethane rubber material, whereby a resolution of a developed image can be maintained at a high level and over a long period.

10. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer;

wherein said developer layer regulating means is formed of a conductive material for applying a bias voltage thereto to prevent the toner particles from being electrostatically adhered to said developer layer regulating means; said developing roller and said developer layer regulating means are constituted in such a manner that work functions thereof approximate, preferably conform with, that of the toner particles; and the toner particles are charged b a charge-injection effect resulting from the application of the bias voltage to said developer layer regulation means, whereby the toner particles can be given a desired charge distribution regardless of variations of temperature and air moisture contents.

11. A developing device as set forth in claim 10, wherein said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound.

12. A developing device as set forth in claim 11, wherein said developing roller has an Asker C-hardness of at most 50°, preferably 35°, and is resiliently pressed against the surface of said electrostatic latent image carrying body, whereby the operating life of said electrostatic latent image carrying body can be prolonged.

13. A developing device as set forth in claim 11, wherein said developing roller has an Asker C-hardness of at most 50°, preferably 35°, and said developer layer regulating means is formed of a metal, whereby variations of the developer layer thickness regulated by said developer layer regulating means can be reduced.

14. A developing device as set forth in claim 11, wherein said conductive open-cell foam rubber material of which said developing roller is formed is a conductive open-cell foam polyurethane rubber material, whereby a resolution of a developed image can be maintained at a high level and over a long period.

15. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer;

wherein said developer layer regulating means is formed of a conductive material for applying a bias voltage thereto to prevent the toner particles from being electrostatically adhered to said developer layer regulating means; and a charge-injection effect resulting from the application of the bias voltage to said developer layer regulation means and a triboelectrification between said developing roller and/or developer layer regulating means and said toner particles are utilized for charging the toner particles;

said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound; and said developing roller having an Asker C-hardness of at most 50°, and is resiliently pressed against the surface of said electrostatic latent image carrying body, whereby the operating life of said electrostatic latent image carrying body can be prolonged.

16. A developing device as set forth in claim 15, wherein said developing roller has an Asker C-hardness of at most 50°, preferably 35°, and said developer layer regulating means is formed of a metal, whereby variations of the developer layer thickness regulated by said developer layer regulating means can be reduced.

17. A developing device as set forth in claim 15, wherein said conductive open-cell foam rubber material of which said developing roller is formed is a conductive open-cell foam polyurethane rubber material, whereby a resolution of a developed image can be maintained at a high level and over a long period.

18. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness, of the developer layer;

wherein said developer layer regulating means is formed of a conductive material for applying a bias voltage thereto to prevent the toner particles from being electrostatically adhered to said developer layer regulating means; and when a charge-injection effect resulting from the application of the bias voltage to said developer layer regulation means is utilized for charging the toner particles, a difference between the bias voltage applied to said developer layer regulating means and a developing bias voltage applied to said developing roller is lower than a level at which a high electrical current or an electrical discharge occurs between said developer layer regulating means and said developing roller;

said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound; and said developing roller having an Asker C-hardness of at most 50°, and is resiliently pressed against the surface of said electrostatic latent image carrying body, whereby the operating life of said electrostatic latent image carrying body can be prolonged.

19. A developing device as set forth in claim 18, wherein said developing roller has an Asker C-hardness of at most 50°, preferably 35°, and said developer layer regulating means is formed of a metal, whereby variations of the developer layer thickness regulated by said developer layer regulating means can be reduced.

20. A developing device as set forth in claim 18, wherein said conductive open-cell foam rubber material of which said developing roller is formed is a conductive open-cell foam polyurethane rubber material, whereby a resolution of a developed image can be maintained at a high level and over a long period.

21. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body; and a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer.

22. A developing device as set forth in claim 21, wherein said developer layer regulating means has an edge which is engaged with a moving surface of said developing roller as a leading edge.

23. A developing device as set forth in claim 22, wherein said developer layer regulating means is tangentially arranged with respect to the moving surface of said developing roller.

24. A developing device using a one-component developer, which device comprises;

a vessel for holding a one-component developer composed of toner particles, said vessel being formed as a hopper having an opening formed therein such that the developer held in said hopper is moved toward said opening by gravity;

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer; and wherein said developing roller is constituted so that a work function thereof approximates, preferably conforms with, that of the toner particles, and the toner particles are charged by a triboelectrification between said developer layer regulating means and the toner particles, whereby the toner particles can be given a desired charge distribution regardless of variations of temperature and air moisture contents.

25. A developing device as set forth in claim 24, wherein said developer layer regulating means has an edge which is engaged with a moving surface of said developing roller as a leading edge.

26. A developing device as set forth in claim 25, wherein said developer layer regulating means is tangentially arranged with respect to the moving surface of said developing roller.

27. A developing device using a one-component developer, which device comprises:

a vessel for holding a one-component developer composed of toner particles, said vessel being formed as a hopper having an opening formed therein such that the developer held in said hopper is moved toward said opening by gravity:

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer; and wherein when the toner particles are charged by a triboelectrification between said developing roller and developer layer regulating means and the toner particles, said developing roller and developer layer regulating means are constituted in such a manner that a relationship of work functions $W_1$ and $W_2$ thereof and a work function $W_1$ of the toner particles is defined by the following formula:

$$(W_1-W_1)\times(W_2-W_3)>0$$

whereby the toner particles can be given a desired distribution.

28. A developing device as set forth in claim 27, wherein said developer layer regulating means has an edge which is engaged with a moving surface of said developing roller as a leading edge.

29. A developing device as set forth in claim 28, wherein said developer layer regulating means is tangentially arranged with respect to the moving surface of said developing roller.

30. A developing device as set forth in claim 27, wherein said developing roller being formed of a conductive open-cell foam rubber material constituted such that a penetration of the toner particles to the open-cell foam structure thereof is prevented, and such that pore openings appear over a surface of said developing roller so that, during a rotation of said developing roller, the toner particles are captured and held by the pore openings of said developing roller to form the developer layer therearound.

31. A developing device as set forth in claim 27, wherein said developing roller has an Asker C-hardness of at most 50°, preferably 35°, and is resiliently pressed against the surface of said electrostatic latent image carrying body, whereby the operating life of said electrostatic latent image carrying body can be prolonged.

32. A developing device as set forth in claim 27, wherein said developing roller has an Asker C-hardness of at most 50°, preferably 35°, and said developer layer regulating means is formed of a metal material, whereby variations of the developer layer thickness regulated by said developer layer regulating means can be reduced.

33. A developing device as set forth in claim 27, wherein said conductive open-cell foam rubber material of which said developing roller is formed is a conductive open-cell foam polyurethane rubber material, whereby a resolution of a developed image can be maintained at a high level and over a long period.

34. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer; and wherein said developer layer regulating means is formed of a conductive material for applying a bias voltage thereto to prevent the toner particles from being electrostatically adhered to said developer layer regulating means; said developing roller and said developer layer regulating means are constituted in such a manner that work functions thereof approximate, preferably conform with, that of the toner particles; and the toner particles are charged by a charge-injection effect resulting from the application of the bias voltage to said developer layer regulation means, whereby the toner particles can be given a desired charge distribution regardless of variations of temperature and air moisture contents.

35. A developing device as set forth in claim 34, wherein said developer layer regulating means has an edge which is engaged with a moving surface of said developing roller as a leading edge.

36. A developing device as set forth in claim 35, wherein said developer layer resulting means is tangentially arranged with respect to the moving surface of said developing roller.

37. A developing device using a one-component developer, which device comprises:

a vessel for holding a one-component developer composed of toner particles, said vessel being formed as a hopper having an opening formed therein such that the developer held in said hopper is moved toward said opening by gravity;

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer; and wherein said developer layer regulating means is formed of a conductive material for applying a bias voltage thereto to prevent the toner particles from being electrostatically adhered to said developer layer regulating means; and a charge-injection effect resulting from the application of the bias voltage to said developer layer regulation means and a triboelectrification between said developing roller and/or developer layer regulating means and said toner particles are utilized for charging the toner particles.

38. A developing device as set forth in claim 37, wherein said developer layer regulating means has an edge which is engaged with a moving surface of said developing roller as a leading edge.

39. A developing device as set forth in claim 38, wherein said developer layer regulating means is tangentially arranged with respect to the moving surface of said developing roller.

40. A developing device using a one-component developer, which device comprises;

a vessel for holding a one-component developer composed of toner particles, said vessel being formed as a hopper having an opening formed therein such that the developer held in said hopper is moved toward said opening by gravity;

a developing roller rotatably provided within the opening of said hopper and positioned at a lowermost area thereof in such a manner that a portion of said developing roller is exposed therefrom and faces the surface of an electrostatic latent image carrying body to form a developing area therebetween, said developing roller being rotated in such a manner that the surface thereof moves upward at said developing area, during the rotation of said developing roller, the toner particles being entrained by the surface of said developing roller to form a developer layer therearound, and being carried to said developing area for a development of an electrostatic latent image formed on said electrostatic latent image carrying body;

a developer layer regulating means provided within the opening of said hopper and resiliently engaged with said developing roller for regulating a thickness of the developer layer formed around said developing roller, said developer layer regulating means being disposed below said developing roller to serve as a stopper for preventing a leakage of the toner particles from the opening of said hopper at an underside of said developing roller, and having an edge which is engaged with a moving surface of said developing roller as a leading edge for the regulation of the thickness of the developer layer; and wherein said developer layer regulating means is formed of a conductive material for applying a bias voltage thereto to prevent the toner particles from being electrostatically adhered to said developer layer regulating means; and when a charge injection effect resulting from the application of the bias voltage to said developer layer regulation means is utilized for charging the toner particles, a difference between the bias voltage applied to said developer layer regulating means and a developing bias voltage applied to said developing roller is lower than a level at which a high electrical current or an electrical discharge occurs between said developer layer regulating means and said developing roller.

41. A developing device as set forth in claim 40, wherein said developer layer regulating means has an edge which is engaged with a moving surface of said developing roller as a leading edge.

42. A developing device as set forth in claim 41, wherein said developer layer regulating means is tangentially arranged with respect to the moving surface of said developing roller.

* * * * *